US012800268B2

(12) United States Patent
Sheets, Jr.

(10) Patent No.: US 12,800,268 B2
(45) **Date of Patent: *Nov. 17, 2026**

(54) THROW LEVER FOR A MAGNIFICATION RING OF AN OPTICAL SIGHT

(71) Applicant: PRIMARY ARMS, LLC, Houston, TX (US)

(72) Inventor: Robert E Sheets, Jr., Houston, TX (US)

(73) Assignee: PRIMARY ARMS, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/215,291

(22) Filed: May 21, 2025

(65) Prior Publication Data

US 2025/0283695 A1 Sep. 11, 2025

Related U.S. Application Data

(63) Continuation of application No. 18/511,599, filed on Nov. 16, 2023, now Pat. No. 12,332,020.

(60) Provisional application No. 63/426,673, filed on Nov. 18, 2022.

(51) Int. Cl.
*F41G 1/38* (2006.01)
*F41G 11/00* (2006.01)

(52) U.S. Cl.
CPC ..... *F41G 1/38* (2013.01); *F41G 11/003* (2013.01)

(58) Field of Classification Search
CPC ..... F41G 1/38; F41G 11/003
USPC ..... 42/119
See application file for complete search history.

(56) References Cited

U.S. PATENT DOCUMENTS 3,492,733 A * 2/1970 Leatherwood ..... G02B 23/14 D16/132
3,782,822 A * 1/1974 Spence ..... G02B 23/145 359/422
4,899,450 A * 2/1990 Huggins ..... F41G 1/38 42/119
5,521,757 A * 5/1996 Olson ..... F41G 11/001 359/425
9,188,763 B2 11/2015 Gibson et al.
(Continued)

FOREIGN PATENT DOCUMENTS

WO WO 2006/053080 A2 5/2006
WO WO 2015/199575 A1 12/2015

OTHER PUBLICATIONS

Bushnell, AR Optics 4.5-18x40 Riflescope Illuminated Multi-Turret, https://www.bushnell.com/scopes/viewe-all-riflescopes/ar-optics-4.5-18x40-riflescope-illuminated-multi-turret/BU-AR741840EI.html, 2020.

(Continued)

*Primary Examiner* — Samir Abdosh
(74) *Attorney, Agent, or Firm* — The Compton Law Firm, P.C.; Scott D. Compton

(57) ABSTRACT

The disclosure is related to a throw lever device for use with at least one magnification ring of at least one optical sight. The throw lever device includes a base member and a lever member pivotally attached to the base member. The lever member includes a detent assembly whereby the lever member may be held in multiple fixed positions about the base member including at least one fixed operable position for turning a magnification ring and at least one fixed non-operable position.

13 Claims, 17 Drawing Sheets

(56) References Cited

U.S. PATENT DOCUMENTS

| | | | | |
|---|---|---|---|---|
| 10,690,444 | B2 | 6/2020 | Davidson et al. | |
| 11,237,379 | B2 | 2/2022 | McCoy, II | |
| 11,768,366 | B1 * | 9/2023 | Gilman | G02B 23/16 74/543 |
| 2006/0123686 | A1 * | 6/2006 | Larue | F41G 11/003 42/127 |
| 2010/0107467 | A1 * | 5/2010 | Samson | F41G 11/003 42/127 |
| 2015/0205066 | A1 * | 7/2015 | Gibson | G02B 7/04 29/428 |
| 2018/0087872 | A1 * | 3/2018 | White | F41G 1/38 |
| 2019/0178610 | A1 | 6/2019 | Davidson et al. | |
| 2023/0228526 | A1 * | 7/2023 | Lee | F41G 1/32 42/111 |
| 2024/0263917 | A1 * | 8/2024 | Alexander | F41G 1/38 |

OTHER PUBLICATIONS

PCT Notification of Transmittal of the International Search Report and the Written Opinion of the International Searching Authority, or the Declaration; Apr. 12, 2024; International Application No. PCT/US2023/080157; International Searching Authority, United States Patent and Trademark Office.

Sheets, Jr., Claims 1-15 of International Application No. PCT/US2023/080157; Nov. 16, 2023.

* cited by examiner

THROW LEVER FOR A MAGNIFICATION RING OF AN OPTICAL SIGHT

CROSS-REFERENCE TO RELATED APPLICATIONS

This application is a continuation of U.S. patent application Ser. No. 18/511,599, filed on Nov. 16, 2023, which is entitled to the benefit of prior-filed U.S. Provisional Patent Application No. 63/426,673, filed on Nov. 18, 2022, the content of which are hereby incorporated by reference in their entirety.

BACKGROUND OF THE DISCLOSURE

1. Field of the Disclosure

This disclosure relates generally in the field of optical sights for firearms.

2. Background Art

A conventional variable power optical sight for a firearm includes a magnification ring configured to be manually rotated about an optical axis of the optical sight to change the magnification of the optical sight to a desired magnification. Because some magnification rings are not easily rotatable manually due to poor surface texture and/or positioning along an optical sight, users often attach a raised tab or lever to a magnification ring to assist with manipulating the magnification ring to more quickly and/or more accurately adjust the magnification of the optical sight. One traditional raised lever or "throw lever" includes a cylindrical clamp portion configured to attach to a magnification ring in a manner similar as a pipe clamp and a lever portion extending out from the clamp portion radially from the optical axis of the optical sight. Due to diametrical differences in magnification rings of various optical sights, a user is often required to use a different throw lever for each of his/her specific optical sights.

Because a traditional throw lever extends out from an optical sight, the throw lever is subject to snagging or catching on items like clothing, user gear, as well as brush and the like when using the optical sight outdoors. To combat this problem, some detachable throw levers have incorporated a hinge in the clamp portion of the throw lever allowing the throw lever to be flipped up and down about the clamp portion. However, cylindrical clamp portions of flip up throw levers are larger or thicker than a traditional clamp portion in order to accommodate a hinge feature. In still other instances, optical sights are manufactured to include a flip up throw lever of a permanent configuration with a spring and detent built into a magnification ring of the optical sight allowing the throw lever to be flipped up and down about the magnification ring. However, a magnification ring of this type is larger than a traditional magnification ring due to the added space required to house the spring and detent. A flip up throw lever is desired that overcomes the above shortcomings.

SUMMARY OF THE DISCLOSURE

The disclosure provides a device for turning a magnification ring of an optical sight, comprising (1) a base member attachable to the magnification ring; and (2) a lever member pivotally attached to the base member; wherein the lever member has a central longitudinal axis; and wherein the lever member comprises a detent assembly axially disposed about the lever member; and wherein the base member and the detent assembly are operationally configured to retain the lever member in a plurality of fixed positions about the base member.

The disclosure also provides a system, comprising (1) at least a first optical sight comprising a magnification ring; (2) a device including (a) a base member attachable to the magnification ring, and (b) a lever member pivotally attached to the base member; wherein the lever member has a central longitudinal axis; wherein the lever member comprises a detent assembly axially disposed about the lever member; and wherein the base member and the detent assembly are operationally configured to retain the lever member in a plurality of fixed positions about the base member.

The disclosure also provides a system, comprising (1) at least a first optical sight and a second optical sight; (2) at least a first mounting interface and a second mounting interface; (3) a device including (a) a base member; and (b) a lever member pivotally attached to the base member; wherein the first optical sight has a first magnification ring with a first mount surface and wherein the second optical sight has a second magnification ring with a second mount surface; wherein the first mounting interface and the second mounting interface are of a like configuration; wherein the first mounting interface is releasably attachable to the first mount surface and wherein the second mounting interface is releasably attachable to the second mount surface; wherein the base member of the device is releasably attachable to the first mounting interface and releasably attachable to the second mounting interface; wherein the lever member has a central longitudinal axis; and wherein the lever member comprises a detent assembly axially disposed about the lever member.

The disclosure also provides an assembly for turning a magnification ring of an optical sight, comprising (1) a device including (a) a base member attachable to the magnification ring, and (b) a lever member pivotally attached to the base member; and (2) a mounting interface for the device attachable to the magnification ring; wherein the lever member has a central longitudinal axis; and wherein the lever member comprises a detent assembly axially disposed about the lever member; and wherein the base member and the detent assembly are operationally configured to retain the lever member in a plurality of fixed positions about the base member.

BRIEF DESCRIPTION OF THE SEVERAL VIEW OF THE DRAWING

DEFINITIONS USED IN THE DISCLOSURE

Figure 1:
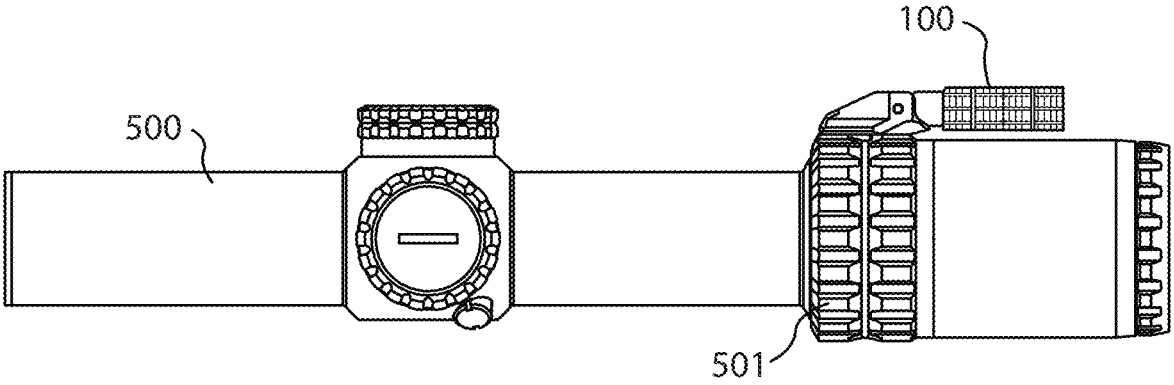
FIG. 1 is a left side view of an embodiment of a system of this disclosure including an embodiment of a throw lever device secured to an embodiment of a magnification ring of an embodiment of a firearm optical sight via an embodiment of a mounting interface wherein the throw lever device is depicted in a non-operable position.

The terms "at least one", "one or more", and "one or a plurality" mean one thing or more than one thing with no limit on the exact number; these three terms may be used interchangeably within this disclosure. For example, at least one device means one or more devices or one device and a plurality of devices.

The term "about" means that a value of a given quantity is within ±20% of the stated value. In other embodiments, the value is within ±15% of the stated value. In other embodiments, the value is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value.

The term "substantially" or "essentially" means that a value of a given quantity is within ±10% of the stated value. In other embodiments, the value is within ±7.5% of the stated value. In other embodiments, the value is within ±5% of the stated value. In other embodiments, the value is within ±2.5% of the stated value. In other embodiments, the value is within ±1% of the stated value. In other embodiments, the value is within ±0.5% of the stated value. In other embodiments, the value is within ±0.1% of the stated value.

The term "and/or" includes any and all combinations of one or more of the associated listed items.

DETAILED DESCRIPTION OF THE DISCLOSURE

For the purposes of promoting an understanding of the principles of the present disclosure, reference is now made to the embodiments illustrated in the drawings and particular language will be used to describe the same. It is understood that no limitation of the scope of the claimed subject matter is intended by way of the present disclosure and the present disclosure is not limited to particular embodiments. As understood by one skilled in the art to which the present disclosure relates, various changes and modifications of the principles as described and illustrated are herein contemplated. It is also to be understood that the terminology used herein is for the purpose of describing particular embodiments only, and is not intended to be limiting. Herein, the term "firearm" may include, but is not limited to a pistol, a semiautomatic firearm, e.g., a semiautomatic rifle, a bolt action firearm, e.g., a bolt action rifle, a shotgun, a revolver, a shoulder fired bazooka, a shoulder fired rocket launcher, an air rifle, and a paintball gun. As understood by the skilled artisan, a particular firearm may be provided in different barrel lengths. Non-limiting examples of pistols are provided in U.S. Pat. No. 4,539,889, titled "Automatic Pistol with Counteracting Spring Control Mechanism," issued on Sep. 10, 1985; and U.S. Pat. No. D918,328 S, titled "Handgun," issued on May 4, 2021, each of which is herein incorporated by reference in its entirety. Non-limiting examples of semiautomatic rifles are provided in U.S. Pat. No. 9,777,975 B2, titled "Semiautomatic Firearm," issued on Oct. 3, 2017; and U.S. Pat. No. 7,775,150 B2, titled "Law Enforcement Carbine with One Piece Receiver," issued on Aug. 17, 2010, each of which is herein incorporated by reference in its entirety. Non-limiting examples of a bolt action firearm are provided in U.S. Pat. No. 8,925,234 B1, titled "Bolt Action Rifle with Safety Latching Mechanism," issued on Jan. 6, 2015; and U.S. Pat. No. 8,397,416 B2, titled "Multi-Caliber Bolt-Action Rifle and Components," issued on Mar. 19, 2013; each of which is herein incorporated by reference in its entirety.

Herein, a person using a throw lever device of this disclosure may be referred to as a "user" or as a "shooter." The term "optical sight" may be used interchangeably with the terms "scope," "scope sight," "optical platform," "sight system," and "telescopic sight." An optical sight for use with a throw lever device of this disclosure suitably includes at least one turnable member including, but not necessarily limited to a turnable magnification ring and/or a turnable collar common to telescopic sights, spotting telescopic sights, firearm optical sights, and the like. Non-limiting examples of an optical sight for use with a throw lever device of this disclosure include first focal plane optical sights, second focal plane optical sights, and dual focal plane optical sights. Non-limiting examples of optical sights comprising a magnification ring are described in U.S. Pat. No. 10,180,565 B2 titled "Viewing Optic with an Integrated Display System," issued on Jan. 15, 2019, which is herein incorporated by reference in its entirety; and United States Patent Application Publication Number US 2011/0314720 A1 titled "Rubber Armored Rifle Scope with Integrated External Laser Sight," published on Dec. 29, 2011, which is herein incorporated by reference in its entirety.

In an embodiment, the disclosure is related to a throw lever device for use with one or more optical sights including, but not limited to one or more firearm variable power optical sights. In an embodiment, the disclosure is related to a low-profile throw lever device for use with a magnification ring of one or more optical sights including, but not limited to one or more firearm variable power optical sights. In an embodiment, a throw lever device may be releasably fastened directly to a magnification ring of an optical sight. In an embodiment, a throw lever device may be releasably fastened to a magnification ring of an optical sight via one or more intermediary members.

In an embodiment, the disclosure is related to a throw lever device for use with a magnification ring of one or more firearm optical sights, wherein the throw lever device comprises an assembly of components including a base member and a lever member pivotally attached to the base member, the lever member comprising a detent assembly axially disposed about the lever member, wherein the base member and the detent assembly are operationally configured to retain the lever member in a plurality of fixed positions about the base member including a non-operable position and one or more operable positions.

In another embodiment, the disclosure is related to a system including one or more optical sights and one or more throw lever devices releasably attachable to a turnable magnification ring of each of the one or more optical sights. In an embodiment, the system includes one or more intermediary members for releasably attaching a throw lever device of the one or more throw lever devices to a magnification ring wherein each magnification ring of the one or more optical sights includes a mount surface operationally configured to receive at least a first intermediary member of the one or more intermediary members. Each throw lever device of the one or more throw lever devices includes (1) a base member releasably attachable to the one or more intermediary members and (2) a lever member pivotally attached to the base member, the lever member comprising a detent assembly axially disposed about the lever member, wherein the base member and the detent assembly are operationally configured to retain the lever member in a plurality of fixed positions about the base member.

In another embodiment, the disclosure is related to a magnification ring throw lever system for one or more optical sights, the system including (1) a throw lever device comprising a base member and a lever member pivotally attached to the base member, and (2) a mounting interface operationally configured to receive the base member in releasable attachment thereto and operationally configured to be releasably attached to one or more magnification rings of one or more firearm optical sights, wherein each magnification ring of the one or more optical sights includes a mount surface for releasable attachment of the mounting interface and wherein the lever member includes a detent assembly axially disposed about the lever member, wherein the base member and the detent assembly are operationally configured to retain the lever member in a plurality of fixed positions about the base member.

In another embodiment, the disclosure is related to a throw lever device for a magnification ring of a firearm optical sight including a lever member comprising a spring and plunger assembly for holding the lever member in a fixed operable position and a fixed non-operable position.

In another embodiment, the disclosure is related to a system comprising an interchangeable throw lever device and at least one firearm optical sight comprising a magnification ring, wherein the throw lever device comprises a mounting interface and the magnification ring comprises a mounting surface for releasable attachment of the mounting interface. In one embodiment, the system includes a plurality of firearm optical sights, each firearm optical sight having a magnification ring with a like mounting surface for receiving the throw lever device in operable attachment.

In another embodiment, the disclosure is related to a throw lever device for manipulating a turnable ring of a cylindrical member. Although a throw lever device of this disclosure may be built to scale, in one embodiment a throw lever device is sized for manual operation with one or more turnable magnification rings of one or more firearm optical sights.

In another embodiment, the disclosure is related to a turnable lever device for manipulating a turnable ring of a cylindrical member.

Figure 2:
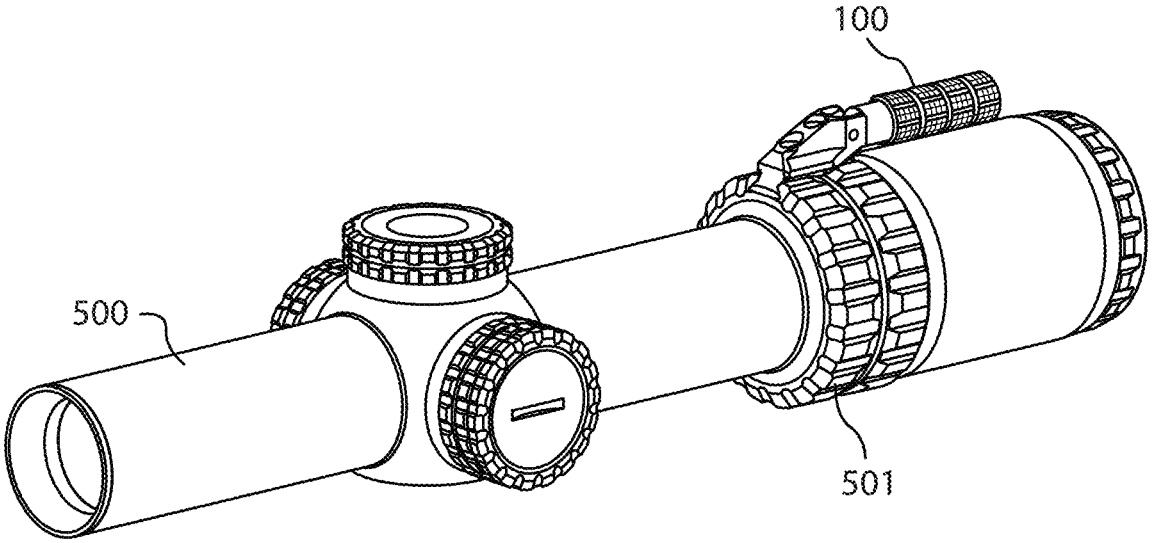
FIG. 2 is a perspective view of the system of FIG. 1 depicting the throw lever device set to a non-operable position.
Figure 3:
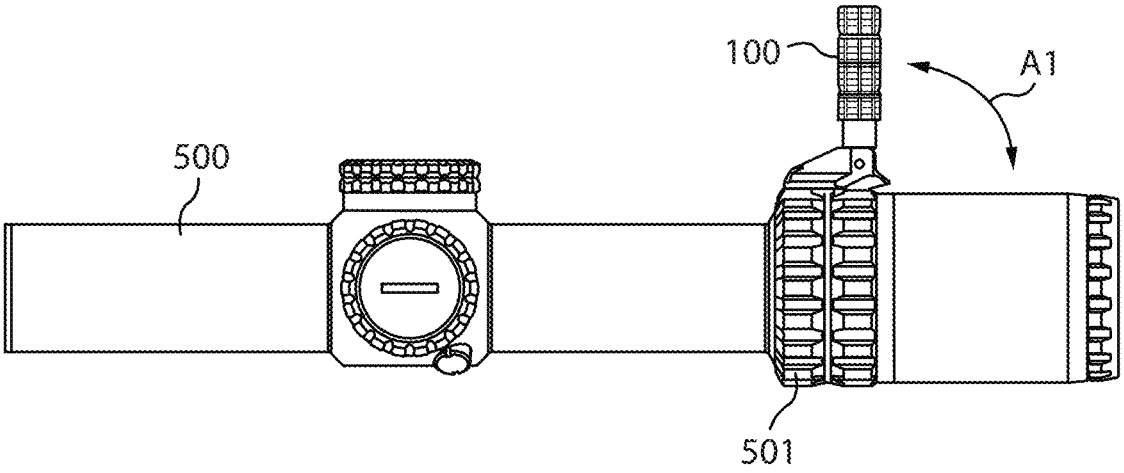
FIG. 3 is a left side view of the system of FIG. 1 depicting the throw lever device set to an operable position.
Figure 4:
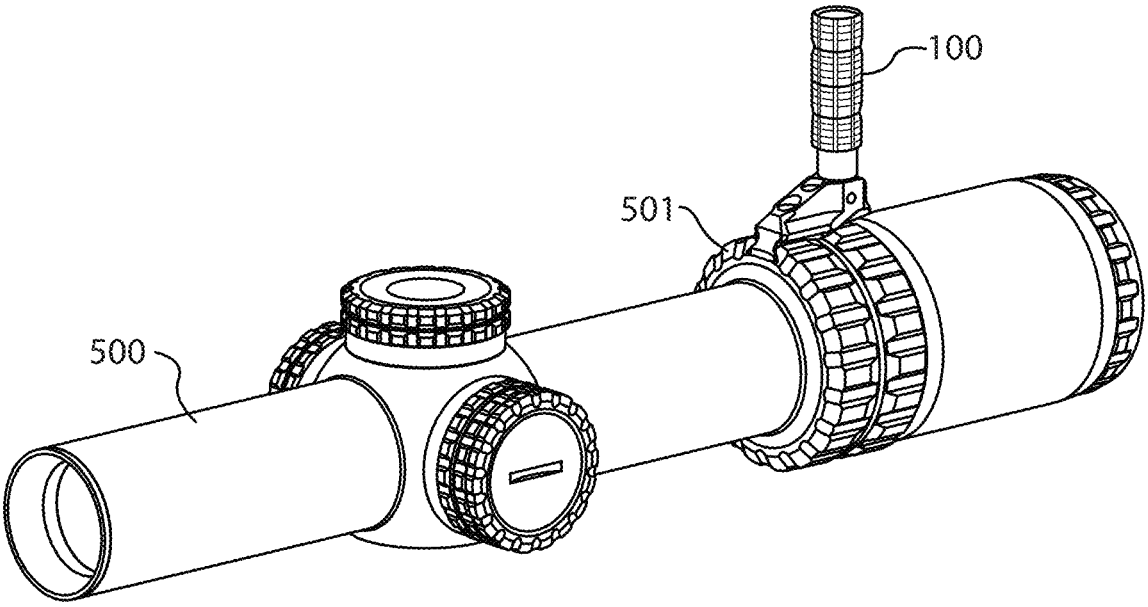
FIG. 4 is a perspective view of the system of FIG. 1 depicting the throw lever device set to an operable position.

As described herein, a throw lever or "throw lever device" of this disclosure is operationally configured for use with a magnification ring of an optical sight including, but not limited to a magnification ring of a firearm optical sight. With reference to FIGS. 1-4, when attached to a magnification ring 501 of a firearm optical sight 500 (hereafter "optical sight 500"), a throw lever device 100 may be directed to a fixed non-operable position as shown in FIGS. 1 and 2 and directed to at least a first fixed operable position as shown in FIGS. 3 and 4. At an operable position, the throw lever device 100 may be used to manually turn a corresponding magnification ring 501 in either direction for purposes of adjusting magnification of an optical sight 500. As described herein, in an embodiment a throw lever device 100 may be used interchangeably amongst a plurality of optical sights 500. For example, a throw lever device 100 may be provided as part of a system comprising a plurality of optical sights 500 each having a magnification ring 501 operationally configured to receive a throw lever device 100 in releasable attachment thereto.

Figure 6:
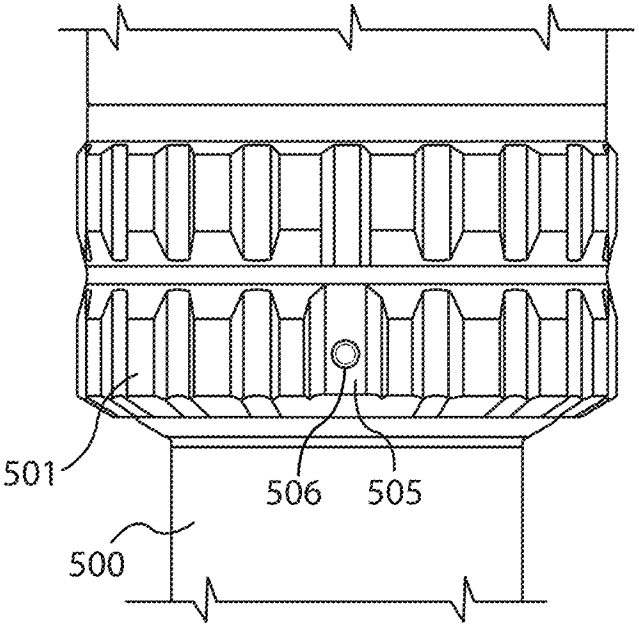
FIG. 6 is a top view of part of a firearm optical sight comprising an embodiment of a magnification ring with a mount surface for the throw lever device of FIG. 5.
Figure 5:
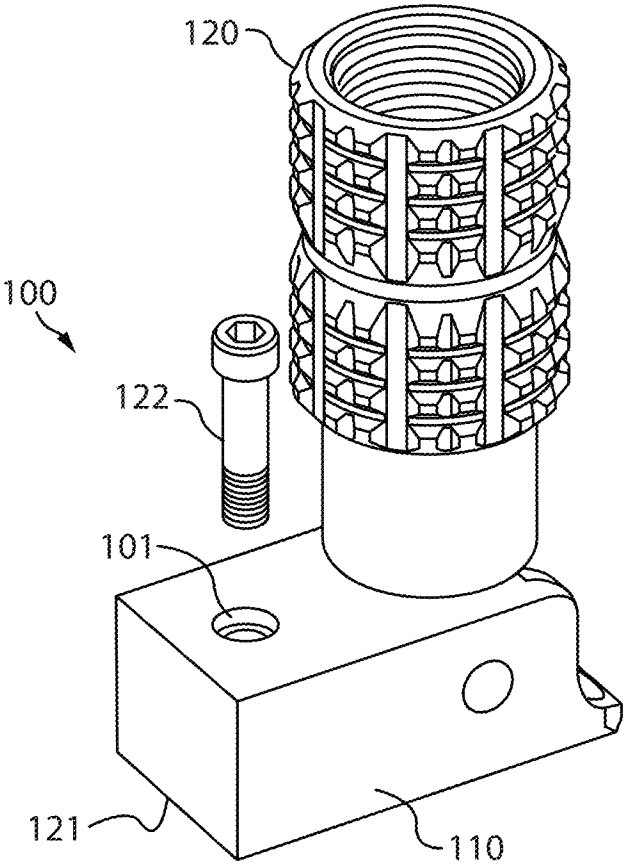
FIG. 5 is a front perspective view of an embodiment of a throw lever device of this disclosure.

With reference to FIGS. 5 and 6, in an embodiment a throw lever device 100 may comprise a main seat or base member 110 operationally configured as a mounting member of the throw lever device 100 that is releasably attachable to a mount surface 505 of a magnification ring 501 of an optical sight 500. In this embodiment, the throw lever device 100 further includes a lever member 120 pivotally attached to the base member 110 about a rotational axis in a manner effective to set the lever member 120 to a fixed non-operable position and to a fixed operable position similar as described above in reference to FIGS. 1-4.

In the embodiment of FIGS. 5 and 6, the base member 110 includes a mounting surface 121 operationally configured to contact or mate with a mount surface 505 of a magnification ring 501 of one or more optical sights 500. Suitably, the mounting surface 121 comprises a surface configuration operable with the mount surface 505. For example, the mounting surface 121 may include a planar surface for contacting a planar mount surface 505. In another embodiment, the mounting surface 121 may include a non-planar surface or other surface configuration and a mount surface 505 may include one or more conformal contacts for the mounting surface 121. In another embodiment, the mounting surface 121 may include a curved surface having a radius of curvature the same or substantially similar as the radius of curvature of a corresponding magnification ring 501.

In the embodiment of FIG. 5, the base member 110 includes one or more through holes 101 corresponding to one or more threaded holes 506 disposed along the mount surface 505 whereby the base member 110 may be releasably fastened to the magnification ring 501 via one or more threaded fasteners 122. Suitable threaded fasteners 112 may include, but are not limited to socket head cap screws, countersunk screws, flathead screws, and combinations thereof. As such, the one or more through holes 101 may be of a type effective to receive one or more particular types of threaded fasteners 112 there through. For example, a through hole 101 may include a counterbore hole as shown in FIG. 5 for receiving a socket head cap screw 122. In another non-limiting example, a through hole 101 may include a countersunk hole for receiving a countersunk screw or flathead screw as understood by the skilled artisan. According to the configuration of the base member 110 as described above, in an embodiment a plurality of optical sights 500 may each comprise a mount surface 505 the same or similar as shown in FIG. 6 whereby the throw lever device 100 may be used as an interchangeable member with each of the optical sights 500.

Turning to FIGS. 7-10, in another embodiment a throw lever device 100 may be releasably attached to a magnification ring 501 of an optical sight 500 via one or more intermediary members such as a mounting interface 105 operationally configured as a uniform attachment for the throw lever device 100 regardless the outer diameter of the magnification ring 501. In other words, a mounting interface 105 as shown in FIGS. 7-10 provides a mount surface of an unvarying size for a corresponding throw lever device 100 regardless the outer diameter of the magnification ring 501 to which the mounting interface 105 is secured. As such, a single throw lever device 100 may be mounted to different optical sights 500 having magnification rings 501 of different outer diameters.

Similar as described above, a lever member 120 of this embodiment is pivotally attached to the base member 120 and may be oriented or set to a fixed non-operable position and to a fixed operable position for turning a corresponding magnification ring 501. A throw lever device 100 of this disclosure may include a one piece lever member 120 of a predetermined length, size and shape. In another embodiment, a throw lever device 100 may include two or more interchangeable lever members 120 of varying length and/or size and/or shape. As shown in FIGS. 7-10 and as described below, in another embodiment a lever member 120 may be comprised of an assembly of components operationally configured to establish a lever member 120 of a desired length and/or size and/or shape.

Figure 9:
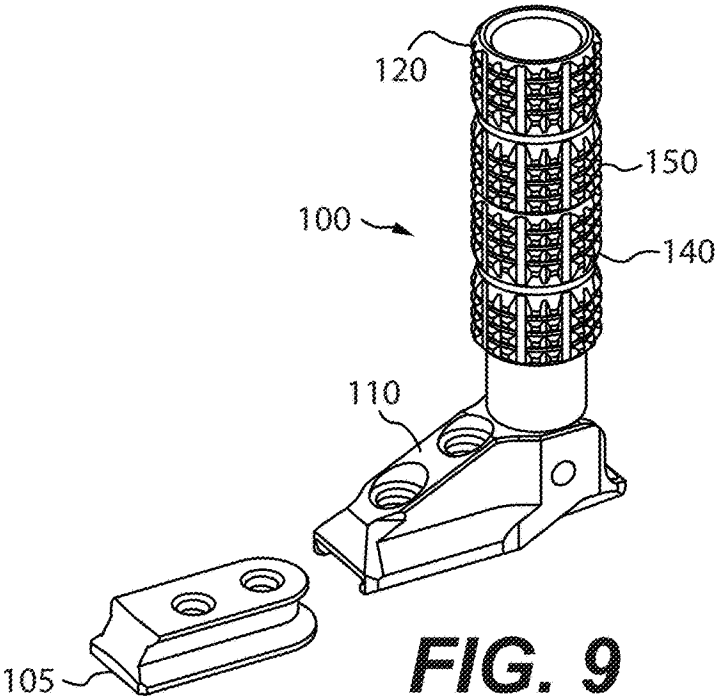
FIG. 9 is a front perspective view of an embodiment of a throw lever device and a mounting interface for use with the throw lever device with the throw lever device depicted in an operable position.
Figure 10:
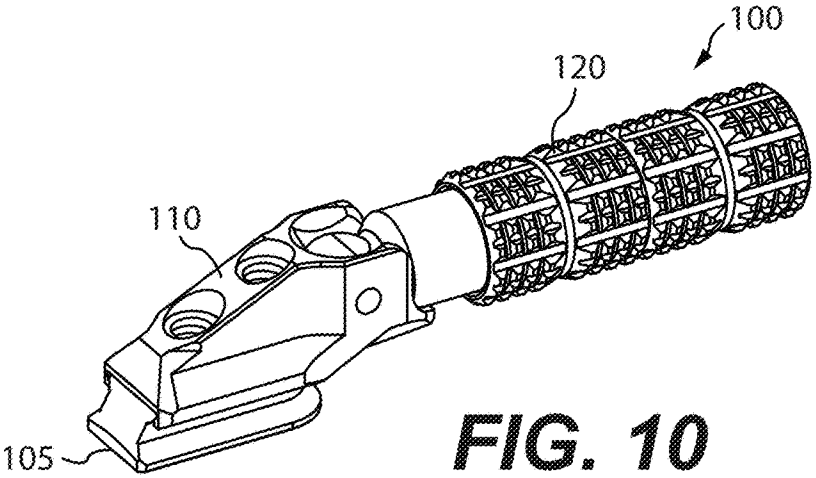
FIG. 10 is a front perspective view of the throw lever device and the mounting interface of FIG. 9 in an attached configuration with the throw lever device depicted in a non-operable position.
Figure 11:
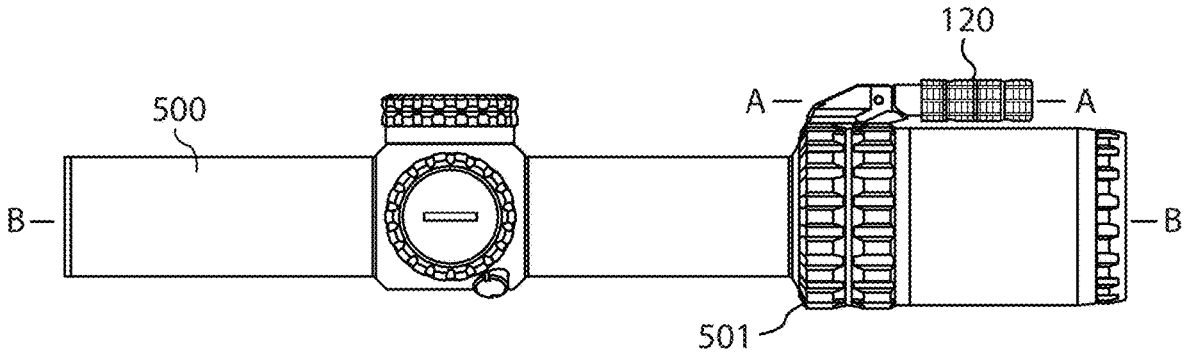
FIG. 11 is a left side view of an embodiment of a system of this disclosure including an embodiment of a throw lever device secured to an embodiment of a magnification ring of an embodiment of a firearm optical sight via an embodiment of a mounting interface wherein the throw lever device is depicted in a non-operable position.
Figure 12:
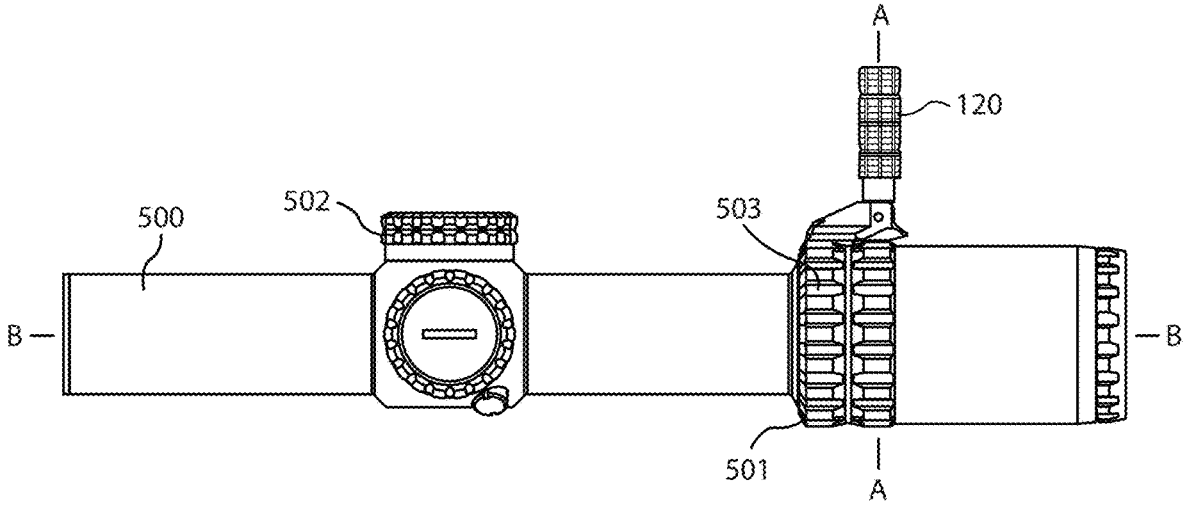
FIG. 12 is a left side view of the system of FIG. 11 depicting the throw lever device set to an operable position.

As shown in FIG. 11, when a lever member 120 of a throw lever device 100 as shown in FIGS. 7-10 is set to a fixed non-operable position (or "flip down" position), a central longitudinal axis A-A of the lever member 120 is parallel to an optical axis B-B of a corresponding optical sight 500. As shown in FIG. 12, when the lever member 120 is set to a fixed operable position (or "flip up" position), the central longitudinal axis A-A is perpendicular to the optical axis B-B wherein the lever member 120 is operationally configured as a radially extending member relative optical axis B-B. In an embodiment, when the throw lever device 100 is set to a fixed operable position the lever member 120 may comprise a length whereby the lever member 120 extends out from a corresponding optical sight 500 a distance greater than any other exterior components of the optical sight 500 as shown in FIG. 12. In another embodiment, the lever member 120 may include a length whereby one or more other exterior components of a corresponding optical sight 500, e.g., a turret 502 of the optical sight 500, may extend out from the optical axis B-B a distance greater than the lever member 120. In another embodiment, a lever member 120 may extend out from the optical axis B-B a distance the same or substantially similar as one or more other exterior components of a corresponding optical sight 500. In still another embodiment, a throw lever device 100 may be operationally configured so that the lever member 120 extends out from a corresponding optical sight 500 in a fixed operable position with the central longitudinal axis A-A set at an angle between 0.0 degrees and 90.0 degrees relative optical axis B-B.

As stated above, although a throw lever device 100 of this disclosure may be built to scale, for manual operation a lever member 120 includes a length and/or size and/or shape suitable to be manipulated by one or more fingers of a hand of a user or other person when secured to a magnification ring 501 of an optical sight 500 whereby force applied to the lever member 120 in either direction applies torque to the corresponding magnification ring 501 for turning the magnification ring 501 in the same direction as the lever member 120. In one non-limiting embodiment, a distal end of a lever member 120 may extend out from a circumferential surface 503 of a corresponding magnification ring 501 at a distance ranging from or about 2.99 cm to or about 4.34 cm (from or about 1.178 inches to or about 1.71 inches). In addition, a lever member 120 for use with an optical sight 500 may include an outer width or outer diameter ranging from or about 0.88 cm to or about 1.0 cm (from or about 0.346 inches to or about 0.394 inches). Suitably, a force may be applied at any point along the length of the lever member 120 for applying a desired torque to a corresponding magnification ring 501. In another embodiment, a lever member 120 may be manually operated to turn a corresponding magnification ring 501 when the lever member 120 is oriented or set to a fixed non-operable position as shown in FIG. 11.

As described below, arresting of the lever member 120 in either a fixed non-operable position or a fixed operable position about the base member 110 is achieved according to the configuration of the base member 110 and the lever member 120. In particular, a lever member 120 of this disclosure includes a detent assembly that is axially disposed about the lever member 120, i.e., axially disposed about the central longitudinal axis A-A of the lever member 120, and operationally configured to be biased against different surfaces of the base member 110 to establish different fixed positions of the lever member 120. By incorporating a detent assembly as part of the lever member 120 the size of a body of a corresponding magnification ring 501 is minimized providing a low profile throw lever device 100, mounting interface 105 and magnification ring 501 combination.

Figure 13:
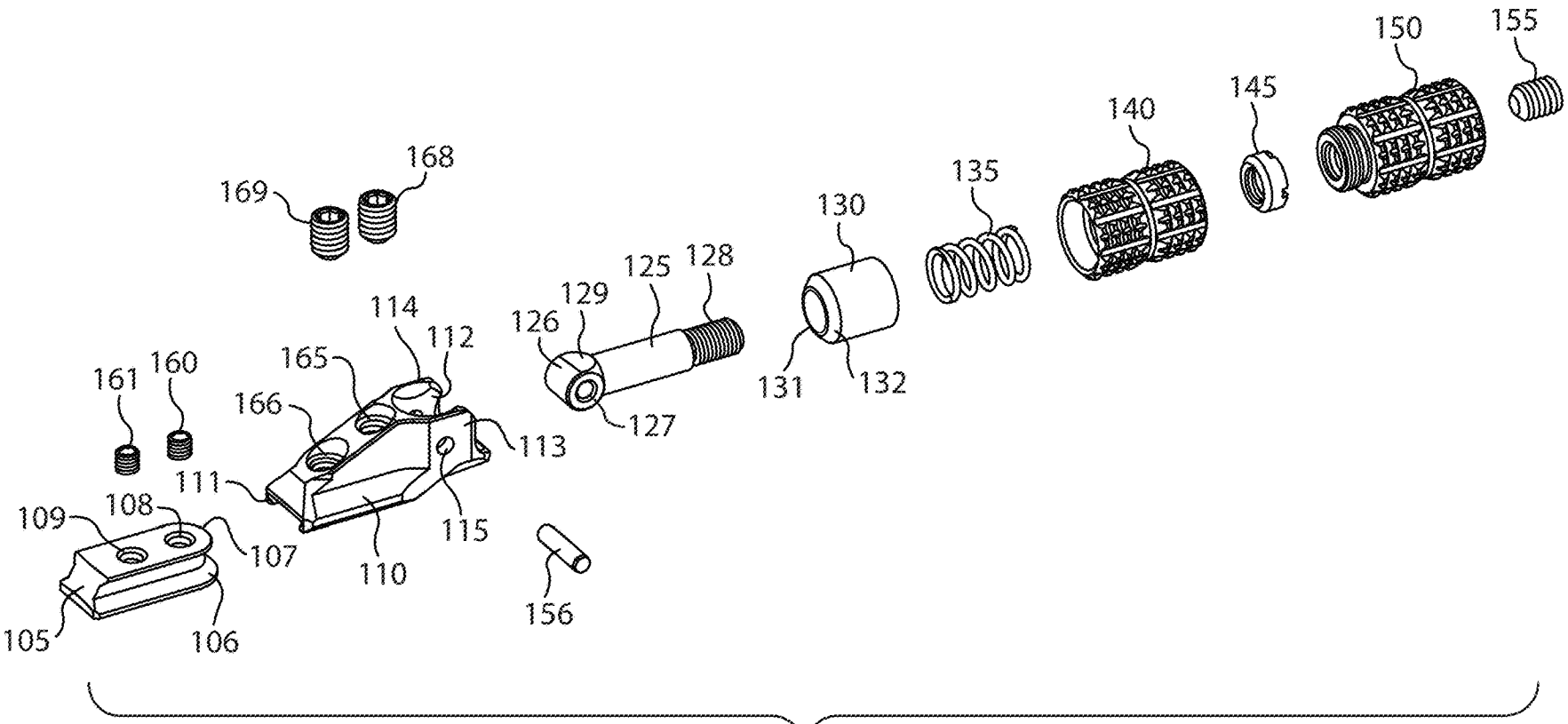
FIG. 13 is an exploded view of an embodiment of a throw lever device of this disclosure and an embodiment of a mounting interface for use with the throw lever device.
Figure 14:
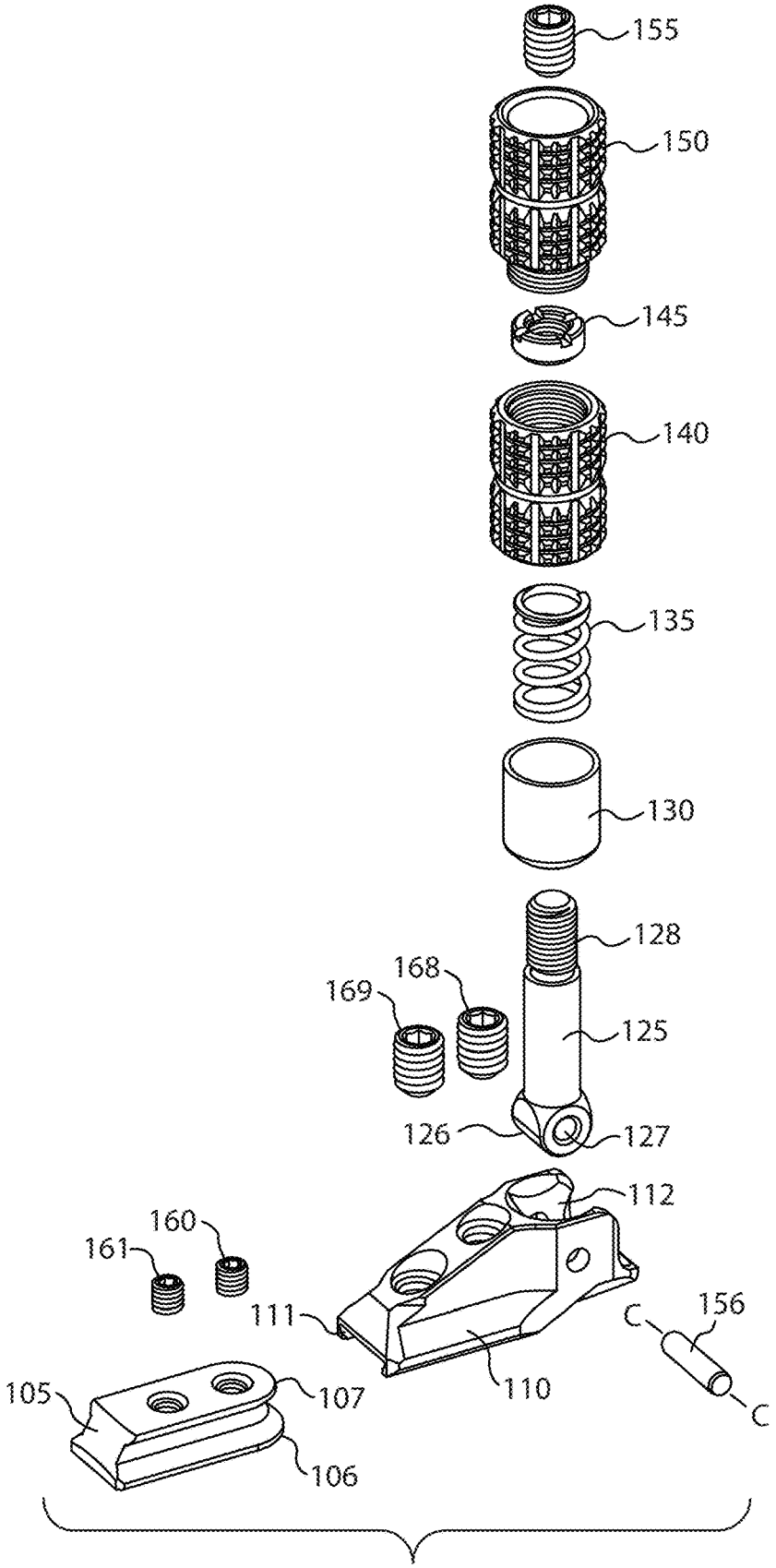
FIG. 14 is another exploded view of the mounting interface and throw lever device of FIG. 13.

With reference to FIGS. 13 and 14, a throw lever device 100 for use with a mounting interface 105 may comprise an assembly of components including a base member 110 and a lever member 120 pivotally attached thereto. In this embodiment, the lever member 120 comprises an assembly including a post member 125, an annular plunger 130, one or more biasing members 135, an annular boss member 140, an annular retaining ring 145, an optional annular first extension member 150 and a threaded fastener, e.g., a set screw 155, coaxial with longitudinal axis A-A. Herein, the post member 125, the plunger 130, the boss member 140 and the one or more biasing members 135 are collectively operationally configured as a detent assembly of the throw lever device 100. In this embodiment, because the lever member 120 carries the one or more biasing members 135, the amount of space afforded within the lever member 120 allows for an increase in size and/or stiffness and/or strength of the one or more biasing members 135 compared to a conventional detent requiring a biasing member housed in a magnification ring of an optical sight. For purposes of this disclosure, a detent assembly may also be referred to as a "biased detent assembly."

Figure 8:
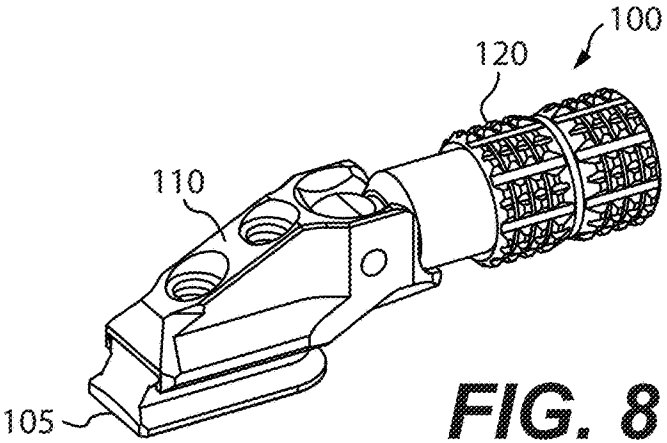
FIG. 8 is a front perspective view of the throw lever device and the mounting interface of FIG. 7 in an attached configuration with the throw lever device depicted in a non-operable position.
Figure 15:
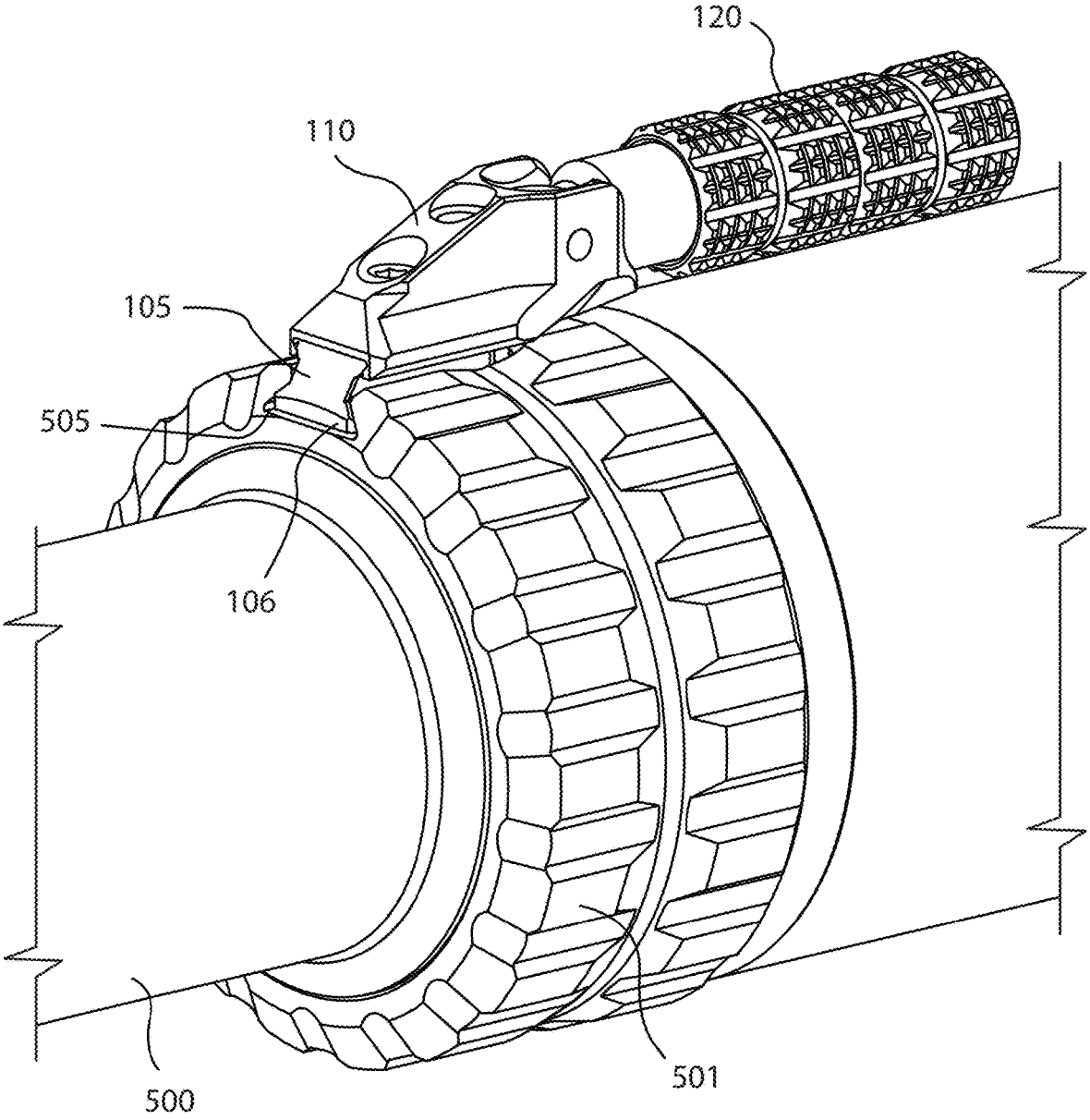
FIG. 15 is a front perspective view of an embodiment of a throw lever device attached to a mounting interface that is mounted to a female dovetail mount surface of a magnification ring of a firearm optical sight depicting the throw lever device set to a non-operable position.
Figure 16:
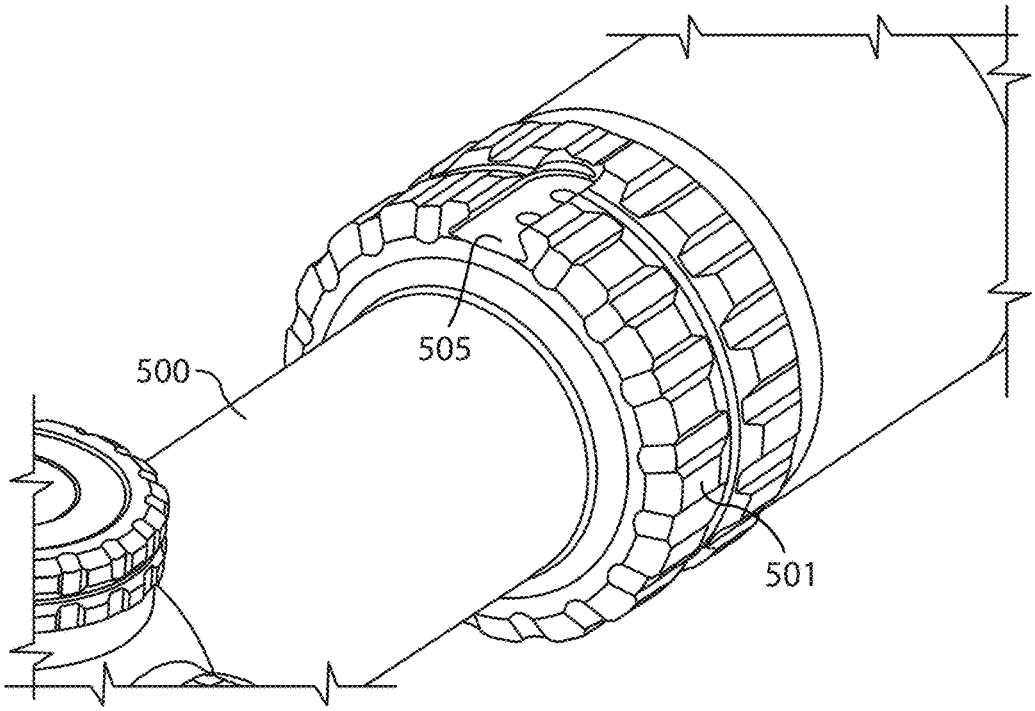
FIG. 16 is a perspective view of part of the firearm optical sight including the female dovetail mount surface of FIG. 15.
Figure 17:
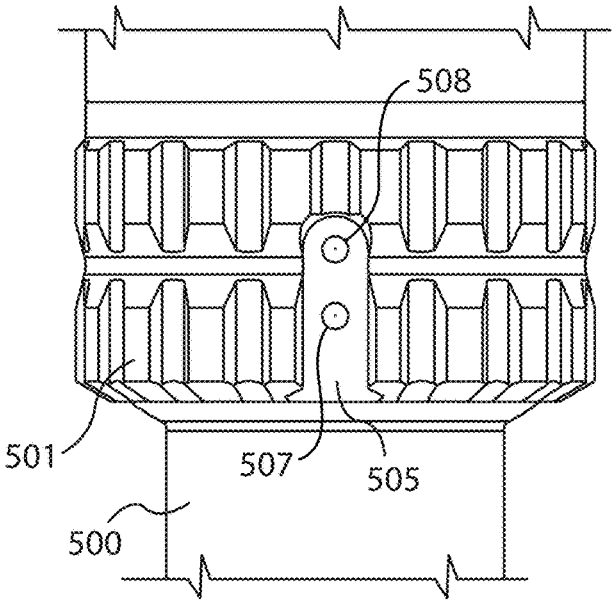
FIG. 17 is a top view of part of the firearm optical sight including the female dovetail mount surface of FIG. 15.

Still referring to FIGS. 13 and 14, in this embodiment the mounting interface 105 comprises a first male dovetail surface 106 for forming a first dovetail joint with a corresponding slot type female dovetail mount surface 505 of a magnification ring 501 as shown in FIG. 15. As such, it is herein contemplated that a plurality of optical sights 500 may be provided each having a magnification ring 501 with a female dovetail mount surface 505 as shown in FIGS. 15-17 whereby each mounting interface 105 operates as a universal type mounting interface 105 for a throw lever device 100. As shown, a base member 110 for use with a mounting interface 105 of this embodiment comprises a slot type female dovetail mount surface 111 for forming a second dovetail joint with a second male dovetail surface 107 of the mounting interface 105 as shown in FIGS. 8, 10 and 15. Accordingly, a mounting interface 105 of this embodiment includes two male dovetail connectors or surfaces operationally configured to form two dovetail joints for releasably attaching a throw lever device 100 to a magnification ring 501.

As understood by the skilled artisan, a mounting interface 105 of a particular size and shape may determine a minimum circumference magnification ring 501 to be used with the mounting interface 105. In other words, when using a mounting interface 105 of a particular size and shape, a body of a magnification ring 501 must be large enough to include a corresponding female dovetail mount surface 505 for receiving the mounting interface 105 therein as shown in FIG. 15. For example, in a non-limiting embodiment including a mounting interface 105 having a height of or about 4.30 mm (0.17 inches) and a first male dovetail connector 106 having an outer width of or about 8.10 mm (0.32 inches), a corresponding a female dovetail mount surface 505 suitably comprises a depth of or about 3.0 mm (0.19 inches) from a circumferential surface 503 of the magnification ring 501 and an inner width for receiving the first male dovetail connector 106 of or about 9.80 mm (0.39 inches). In another embodiment, a circumferential surface 503 of a magnification ring 501 may include additional material forming part of the body of the magnification ring 501 of a size suitable for forming a female dovetail mount surface 505 therein.

In an embodiment, including a first male dovetail connector 106 and a second male dovetail connector 107 of equal or substantially equal outer widths as depicted, a female dovetail mount surface 111 of a base member 110 suitably includes an inner width the same or substantially similar as the inner width of a female dovetail mount surface 505. In another embodiment, a first male dovetail connector 106 and a second male dovetail connector 107 of a mounting interface 105 may include dissimilar widths for mating with a female dovetail mount surface 505 of a magnification ring 501 and a female dovetail mount surface 111 of the base member 110 comprising corresponding dissimilar inner widths.

Referring to FIGS. 13 and 14, the base member 110 comprises a pivot attachment surface for the lever member 120 provided as a socket type surface ("socket 112") operationally configured to receive a proximal end 126 (or "eye end 126") of the post member 125 therein for pivoting of the lever member 120. As shown, the socket 112 includes opposing side wall members 113 and 114 with concentric apertures 115 and 116 (see also FIG. 18) for receiving a pivot pin 156 there through, wherein the lever member 120 pivots about a rotational axis along a single plane perpendicular to a central axis C-C of the pivot pin 156 (see directional arrow A1 in FIG. 3). For purposes of this disclosure, the pivot pin 156 may be referred to as a fulcrum of the lever member 120, i.e., a fulcrum of the throw lever device 100.

In this embodiment, the post member 125 comprises a proximal eye end 126 for mating with an inner surface of the socket 112 in a hinge joint configuration. As shown, the eye end 126 includes an aperture 127 for receiving the pivot pin 156 there through when the aperture 127 is concentrically aligned with apertures 115 and 116 of the socket 112. Suitably, the eye end 126 includes an outer surface configuration suitable for providing angular movement of the post member 125 about the pivot pin 156 within the socket 112 for directing the lever member 120 to a non-operable position as shown in FIGS. 1 and 2 and an operable position as shown in FIGS. 3 and 4. Without limiting the eye end 126 to a particular configuration, in an embodiment the proximal end of the post member 125 may comprise a curved surface configuration. In an embodiment as shown in FIGS. 13 and 14, the eye end 126 may comprise a cylindrical type body with a curved surface at a proximal end of the post member 125 with opposing planar outer surfaces (see planar surface 129 in FIG. 13).

Figure 18:
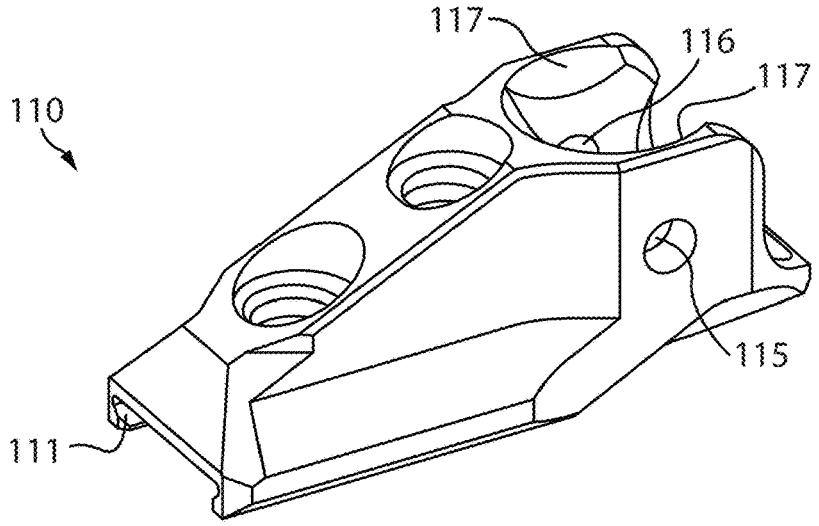
FIG. 18 is a front perspective view of an embodiment of a base member of a throw lever device of this disclosure.
Figure 19:
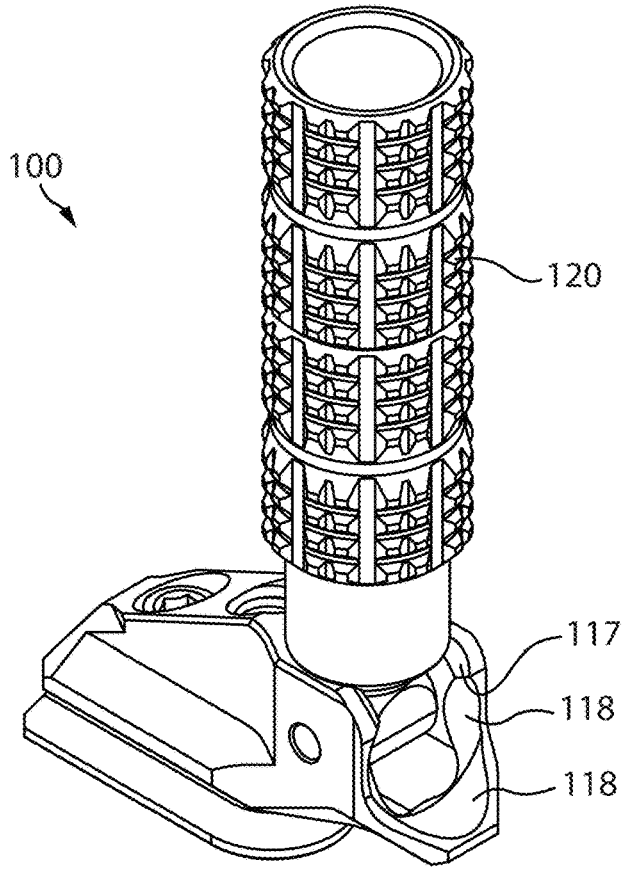
FIG. 19 is a rear perspective view of an embodiment of a mounting interface assembled with a throw lever device depicting the throw lever device set to an operable position.
Figure 20:
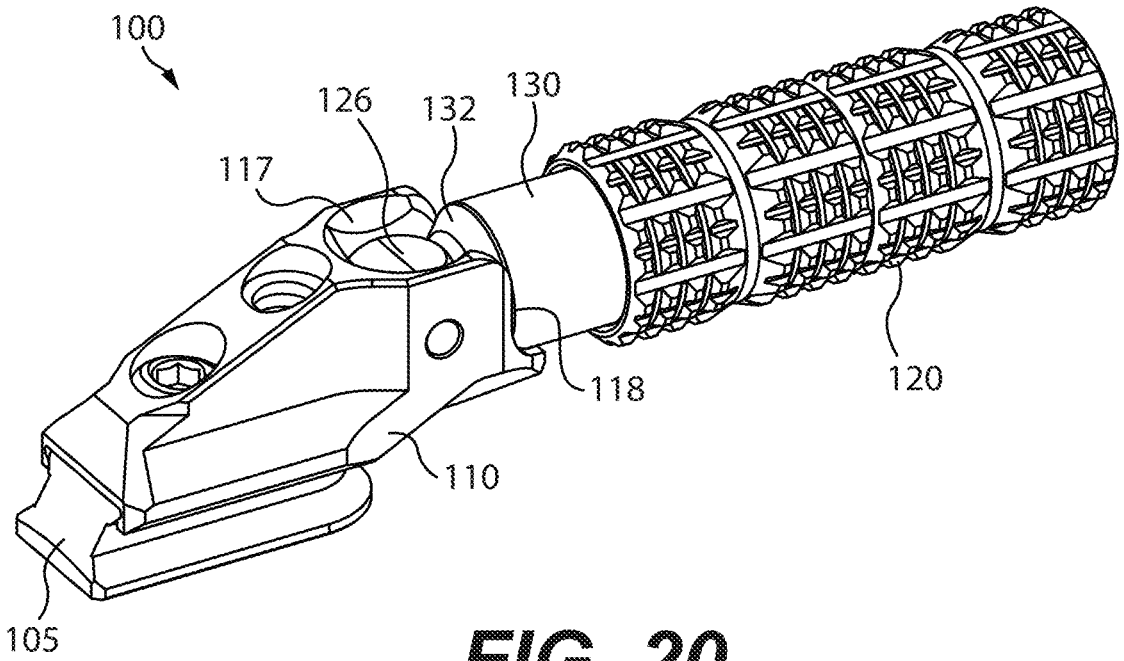
FIG. 20 is a front perspective view of the mounting interface and throw lever device of FIG. 19 depicting the throw lever device set to a non-operable position.
Figure 21:
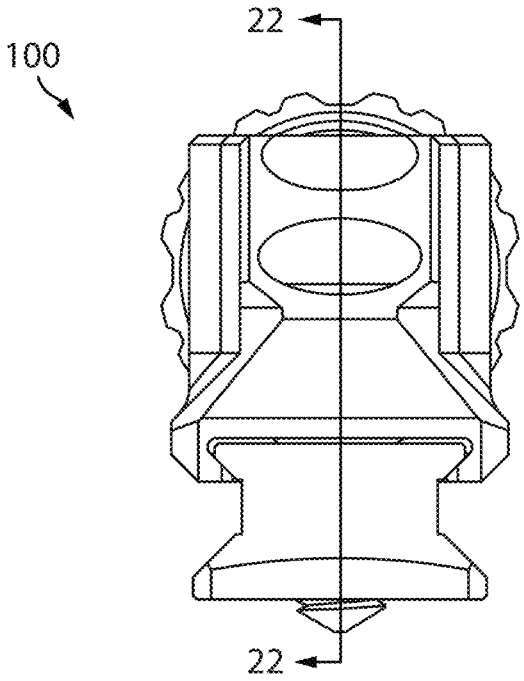
FIG. 21 is a front view of the mounting interface and throw lever device of FIG. 19 depicting the throw lever device set to a non-operable position.
Figure 25:
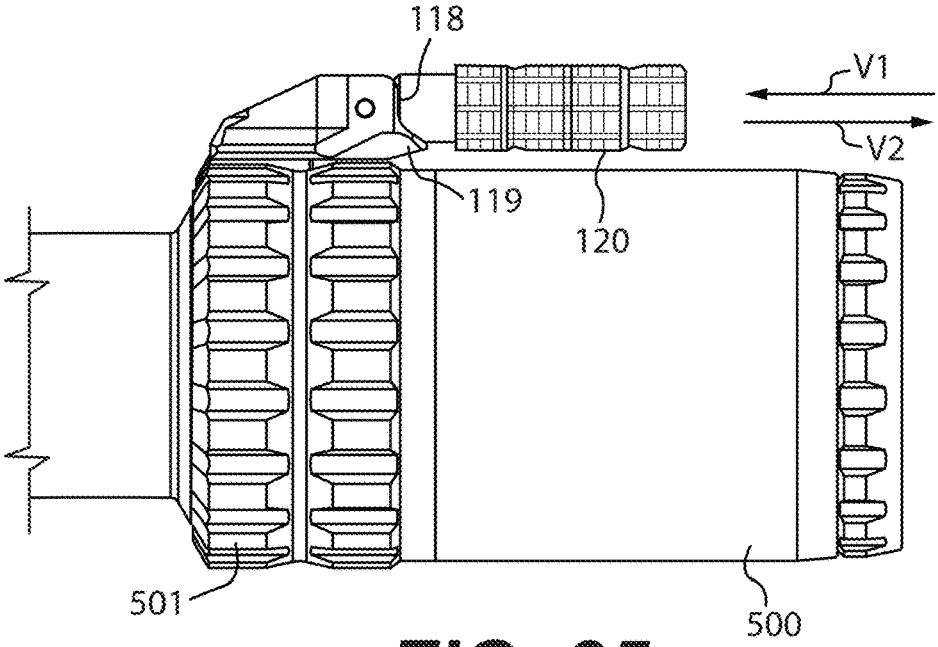
FIG. 25 is a left side view of the mounting interface and throw lever device of FIG. 19 attached to a magnification ring of a firearm optical sight depicting the throw lever device set to a non-operable position.
Figure 26:
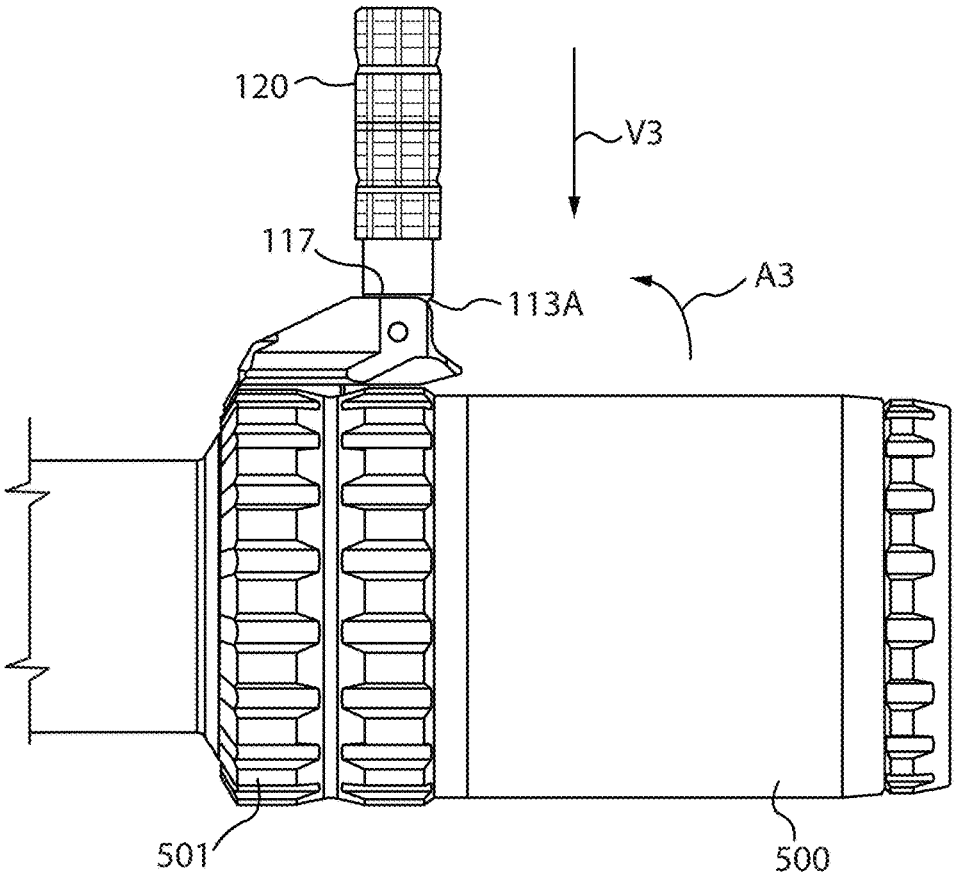
FIG. 26 is a left side view of the mounting interface and throw lever device of FIG. 25 depicting the throw lever device set to an operable position.

With further reference to FIGS. 13 and 14, the plunger 130 (or "detent plunger 130") is provided as a ring or band type member with an opening 131 for receiving the post member 125 there through in a manner effective for a proximal end of the plunger 130 to contact part of the socket 112. In this embodiment, the proximal end of the plunger 130 includes a beveled surface 132 for contacting corresponding mating surfaces of the socket 112. Referring to FIG. 18, the mating surfaces of the socket 112 include a first seat 117 of mating surfaces for receiving the beveled surface 132 in abutment thereto when the lever member 120 is set to an operable position as shown in FIG. 19. As shown in FIG. 19, the socket 112 includes a second seat 118 perpendicular to the first seat 117 with mating surfaces for receiving the beveled surface 132 in abutment thereto when the lever member 120 is set to a non-operable position as shown in FIG. 20. As shown in FIGS. 25 and 26, the configuration of the first seat 117 and the second seat 118 are operationally configured to receive and hold the plunger 130 in a fixed position thereby limiting the range of angular travel of the lever member 120 to or about 90.0 degrees between a non-operable position and an operable position.

Although the base member 110 of this embodiment includes a first seat 117 and a second seat 118 offset ninety degrees, in another embodiment a base member 110 may include one or more additional seats disposed between the first and second seats 117, 118 and offset at one or more angles as desired, e.g., a third seat offset at an angle of forty-five degrees. In addition, part of the second seat 118 of the socket 112 may include an extended portion or ledge 119 operationally configured as a stop for the lever member 120 to prevent the lever member 120 from contacting a corresponding optical sight 500—see FIG. 25, which depicts the lever member 120 set to a non-operable position against the ledge 119 spaced apart from the optical sight 500.

Figure 22:
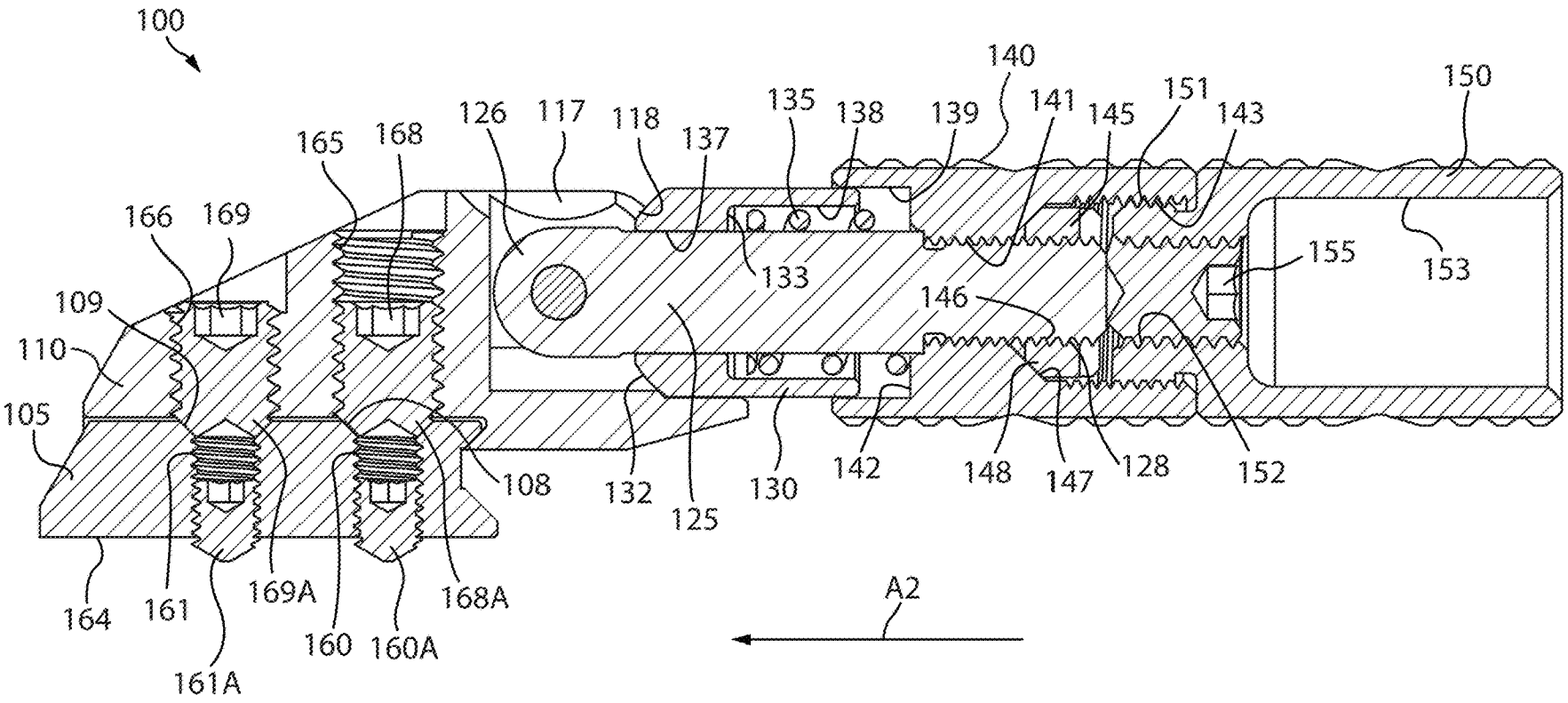
FIG. 22 is a sectional side view of the mounting interface and throw lever device of FIG. 21.
Figure 24:
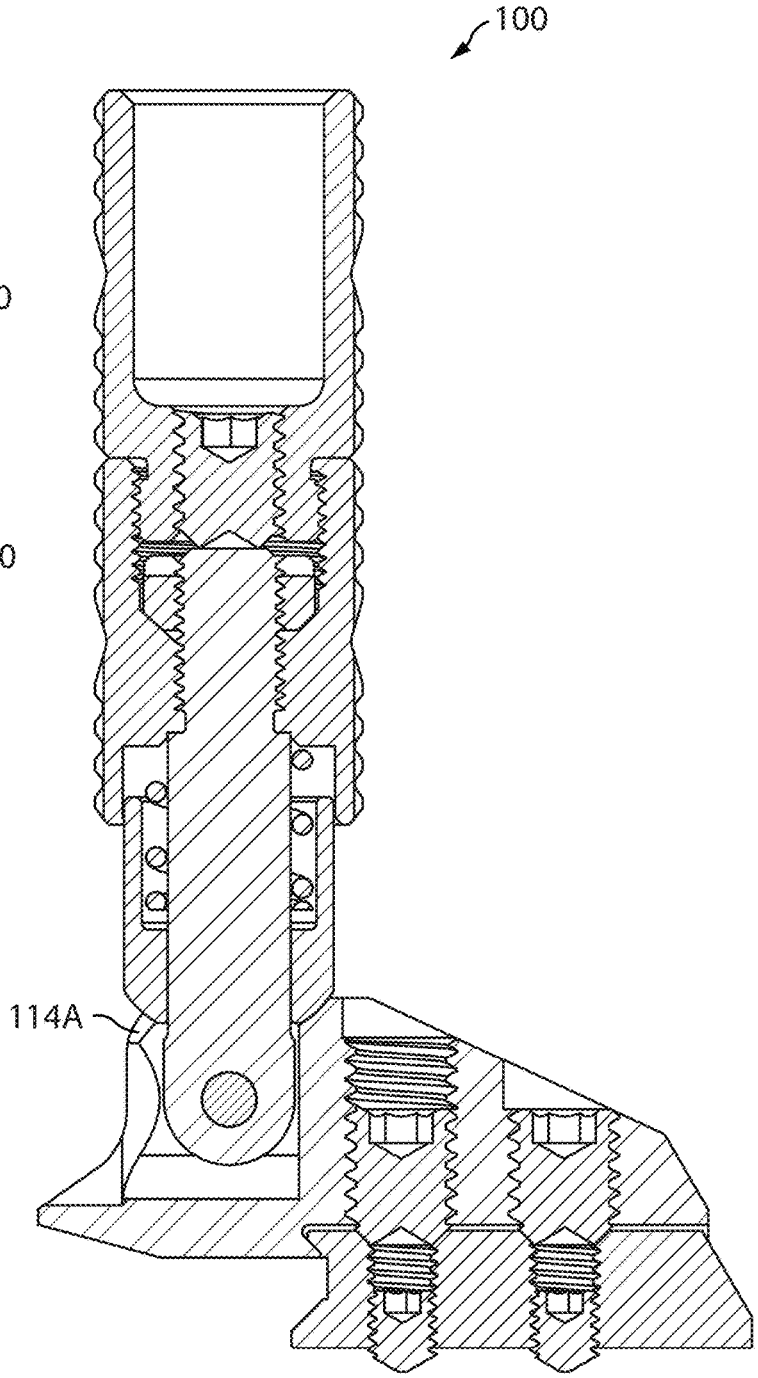
FIG. 24 is a sectional side view of the mounting interface and throw lever device of FIG. 23.

Referring to FIG. 22, the inner surface of the plunger 130 includes a first inner surface 137 of a first inner diameter for receiving the post member 125 there through and a second inner surface 138 of a second inner diameter greater than the first inner diameter providing a space for holding a proximal portion of a biasing member 135 disposed around part of the post member 125 as shown. In this embodiment, a junction between the first inner surface 137 and the second inner surface 138 is defined by an annular seat 133 operationally configured as an abutment surface for a proximal end of the biasing member 135. In one embodiment, the biasing member 135 may include a helical spring with a proximal end axially disposed within the plunger 130 and a distal end disposed within the boss member 140. As shown, the boss member 140 is operationally configured as a housing for at least part of the biasing member 135 and at least part of the plunger 130. In particular, the boss member 140 includes an axial through hole with an open space having a first non-threaded inner surface 139 at a proximal end of the boss member 140 for holding a distal part of the biasing member 135 disposed around part of the post member 125. As shown, the inner surface 139 includes an inner diameter slightly greater than an outer diameter of the plunger 130 wherein a distal part of the plunger 130 may be disposed or mated within the boss member 140 forming an enclosure of the biasing member 135. The boss member 140 also includes a first inner threaded surface 141 operationally configured to be threadedly communicated with a distal outer threaded surface 128 of the post member 125 effective for fixing the position of the post member 125 relative the boss member 140. In this embodiment, a junction between the inner surface 139 and the first inner threaded surface 141 is defined by an annular seat 142 operationally configured as an abutment surface for a distal end of the biasing member 135. In one mode of assembly, as the boss member 140 is threaded onto the threaded surface 128 of the post member 125, the boss member 140 is directed linearly toward the base member 110 (see directional arrow A2) whereby the annular seat 142 applies a force to the biasing member 135, which in turn applies a biasing force to the annular seat 133 effective to bias the plunger 130 against the second seat 118 as shown in FIG. 22 or against the first seat 117 when the lever member 120 is set at an operable position as shown in FIG. 24.

Figure 7:
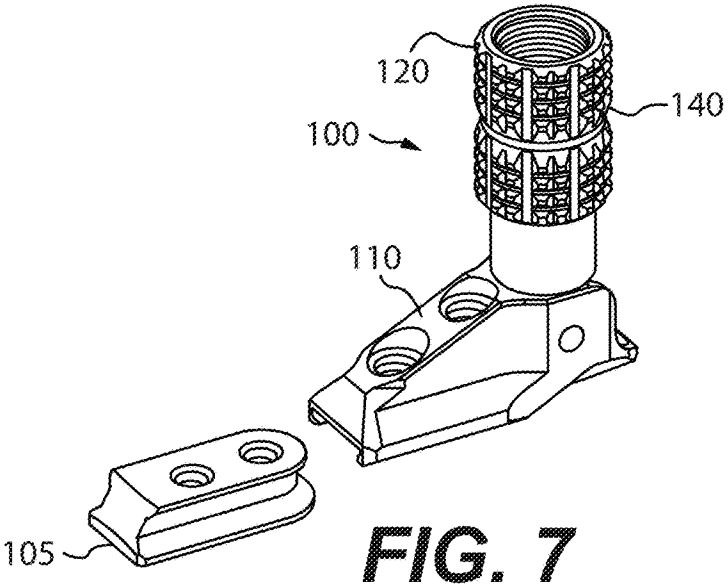
FIG. 7 is a front perspective view of an embodiment of a throw lever device and a mounting interface for use with the throw lever device with the throw lever device depicted in an operable position.

As shown in FIGS. 7 and 8, the entirety of the lever member 120 of a throw lever device 100 may include the boss member 140 as the most distal component whereby the length of the lever member 120 may be determined, at least in part, according to the length of the boss member 140. As shown in FIGS. 9 and 10, a lever member 120 may be extended in length via the addition of one or more additional components including at least a first extension member 150 operationally configured to be threadedly communicated with a distal end of the boss member 140.

Referring again to FIG. 22, the distal end of the boss member 140 includes an open space defined by an inner surface for receiving a retaining ring 145 therein, the retaining ring 145 having an inner threaded surface 146 operationally configured for threaded communication with the most distal part of the outer threaded surface 128 of the post member 125. In this embodiment, the open space of the boss member 140 includes a second non-threaded inner surface 147 operationally configured as an abutment surface for part of a proximal end 148 of the retaining ring 145 when the retaining ring 145 is in threaded communication with the post member 125 as shown. In operation, the retaining ring 145 is operationally configured to be adhered in a fixed position and tension the first inner threaded surface 141 of the boss member 140. Suitable adhesives for use with a retaining ring 145 may include, but are not limited to threadlocker adhesives and two-part epoxy compositions.

The distal end of the boss member 140 is also operationally configured to receive a proximal end of a first extension member 150 therein in a manner effective to enclose the retaining ring 145 as shown in FIG. 22. In this embodiment, the distal end of the boss member 140 includes a second inner threaded surface 143 for threaded communication with an outer threaded surface 151 of a proximal end of the first extension member 150. In this embodiment, the first extension member 150 includes an axial through hole including a first inner threaded surface 152 of a first inner diameter at a proximal end of the first extension member 150 for receiving set screw 155 in threaded communication therein. In this embodiment, the set screw 155 is operationally configured to tension the first inner threaded surface 152 of the first extension member 150 when the first extension member 150 is threadedly communicated with the boss member 140. The first extension member 150 also includes a first non-threaded inner surface 153 of a second inner diameter greater than the first inner diameter providing an open space for accessing the set screw 155 when screwing the set screw 155 on and off of the first inner threaded surface 152 of the first extension member 150.

With reference to FIGS. 13 and 14, the mounting interface 105 may include one or more threaded countersunk holes 108 and 109 for receiving set screws 160 and 161 at a depth therein whereby the proximal ends 160A and 161A of the set screws 160 and 161 extend out past a mating surface 164 of the mounting interface 105 (see FIG. 22) for mating with corresponding female surfaces 507 and 508, e.g., cavities, dimples, disposed along the female dovetail mount surface 505 of a magnification ring 501 of an optical sight 500 (see FIG. 17) in a manner effective to load the threads of the set screws 160 and 161 and tension the mounting interface 105 during operation of the throw lever device 100 by forcing the first male dovetail surface 106 against the female dovetail mount surface 505. In addition, the base member 110 may include one or more threaded holes 165 and 166 for receiving set screws 168 and 169 there through in a manner effective for the proximal ends 168A and 169A of the set screws 168 and 169 to mate with the countersunk holes 108 and 109 of the mounting interface 105 (see FIG. 22). As such, the length of the set screws 160 and 161 is suitably less than the depth of the threaded holes 108 and 109 so that the proximal ends 168A and 169A of the larger diameter set screws 168 and 169 are free to mate with the countersunk holes 108 and 109 in a manner effective to load the threads of the set screws 168 and 169 and tension the mounting interface 105 during operation of the throw lever device 100 by forcing the second male dovetail surface 107 against the female dovetail mount surface 111 of the base member 110.

In an embodiment, a mounting interface 105 may be releasably attached to a female dovetail mount surface 505 of a magnification ring 501. In another embodiment, a mounting interface 105 may be permanently attached to a female dovetail mount surface 505 of a magnification ring 501 via one or more adhesives for adhering the set screws 160 and 161 within the threaded holes 507 and 508. Suitable adhesives for use with set screws 160 and 161 may include, but are not limited to threadlocker adhesives and two-part epoxy compositions. For purposes of this disclosure, when a mounting interface 105 is operably attached to a magnification ring 501, in an embodiment the mounting interface 105 may be considered as part of the magnification ring 501 whereby attaching a throw lever device 100 to a mounting device 105 may be also be referred to as attaching the throw lever device 100 to the magnification ring 501. Moreover, in another embodiment a magnification ring 501 may include a male dovetail connector similar as second male dovetail connector 107 provided as original construction of the magnification ring 501 for receiving a female dovetail mount surface 111 of a base member 110.

Referring to FIGS. 25 and 26, in operation when the throw lever device 100 is set to a non-operable position (see FIG. 25) a biasing force is applied to the plunger 130 via the biasing member 135 (see vector arrow V1) directing the beveled surface 132 of the plunger 130 to an abutment position against the second seat 118 of the socket 112 of the base member 110. As the lever member 120 is directed to an operable position (see directional arrow A3 in FIG. 26), the biasing force of the biasing member 135 is overcome by the forced engagement of the beveled surface 132 of the plunger 130 against curved faces 113A and 114A (see FIGS. 23 and 24) of the opposing side wall members 113 and 114 of the socket 112 (see vector arrow V2). Once the lever member 120 is directed to an operable position as shown in FIG. 26, a biasing force is applied to the plunger 130 via the biasing member 135 (see vector arrow V3) directing the beveled surface 132 of the plunger 130 to an abutment position against the first seat 117 of the socket 112.

The components comprising a throw lever device 100 and mounting interface 105 of this disclosure may be constructed of one or more materials durable for one or more operations and/or as may be required by law or regulation. Suitable materials of construction may include, but are not necessarily limited to those materials resistant to chipping, cracking, excessive bending and reshaping as a result of ozone, weathering, heat, moisture, other outside mechanical and chemical influences, as well as physical impacts. Suitable materials of construction may include one or more metals, plastics, rubbers, woods, filled composite materials, and combinations thereof. Suitable metals may include, but are not necessarily limited to stainless steel, hardened steel, mild steel, aluminum, copper, nickel, brass, titanium, and combinations thereof. Suitable plastics may include, but are not necessarily limited to glass-filled polymers, durable plastic composite materials, and combinations thereof. One suitable glass-filled polymer may include, but is not necessarily limited to glass-filled nylon. One or more adhesives and/or sealants may be used to secure and/or seal one or more components described herein. In addition, one or more heat treatments and/or one or more coatings may be applied to one or more components of a throw lever device 100 and/or mounting interface 105 described herein.

Figure 23:
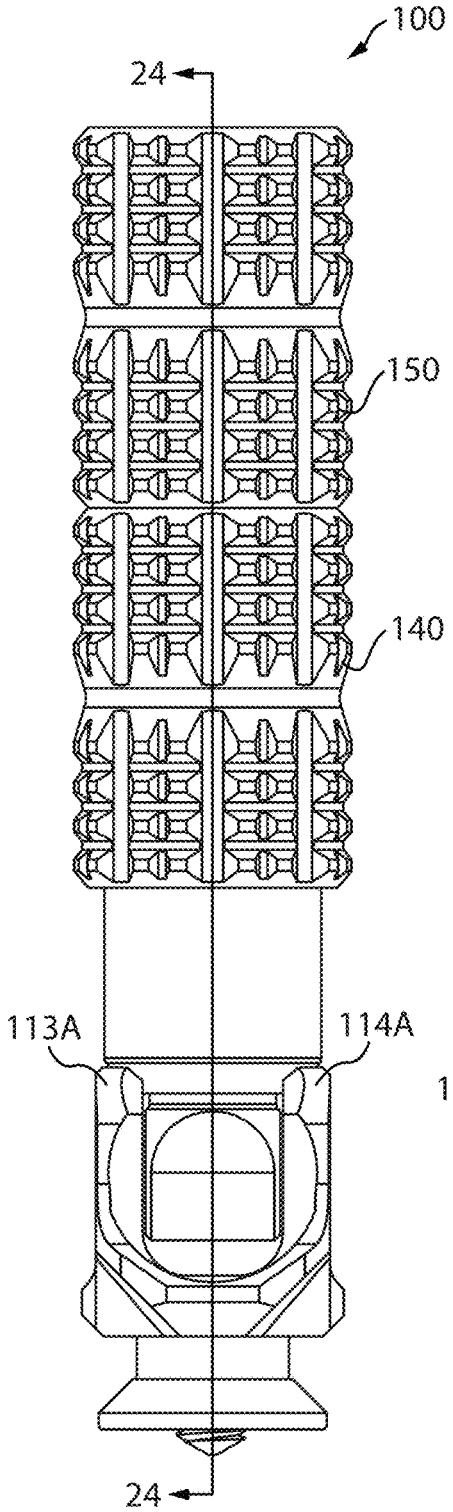
FIG. 23 is a rear view of the mounting interface and throw lever device of FIG. 19 depicting the throw lever device set to an operable position.

Referring to FIG. 23, in one embodiment the boss member 140 and the first extension member 150, as well as one or more additional extension members, may include corresponding ornamental surface features as shown. In an embodiment, the boss member 140 and the first extension member 150, as well as one or more additional extension members, may include knurling or other grip enhancing surface configuration(s). In another embodiment, one or more grip materials may be applied to the outer surface of one or more of the boss member 140, the first extension member 150, and one or more additional extension members as desired, e.g., one or more rubber grip materials, one or more plastic grip materials, one or more leather grip materials, and combinations thereof. In another embodiment, one or more of the boss member 140, the first extension member 150, and one or more additional extension members may include ornamental surface features different than other components of the lever member 120.

The disclosure will be better understood with reference to the following non-limiting examples, which are illustrative only and not intended to limit the present disclosure to a particular embodiment.

Example 1

Figure 27:
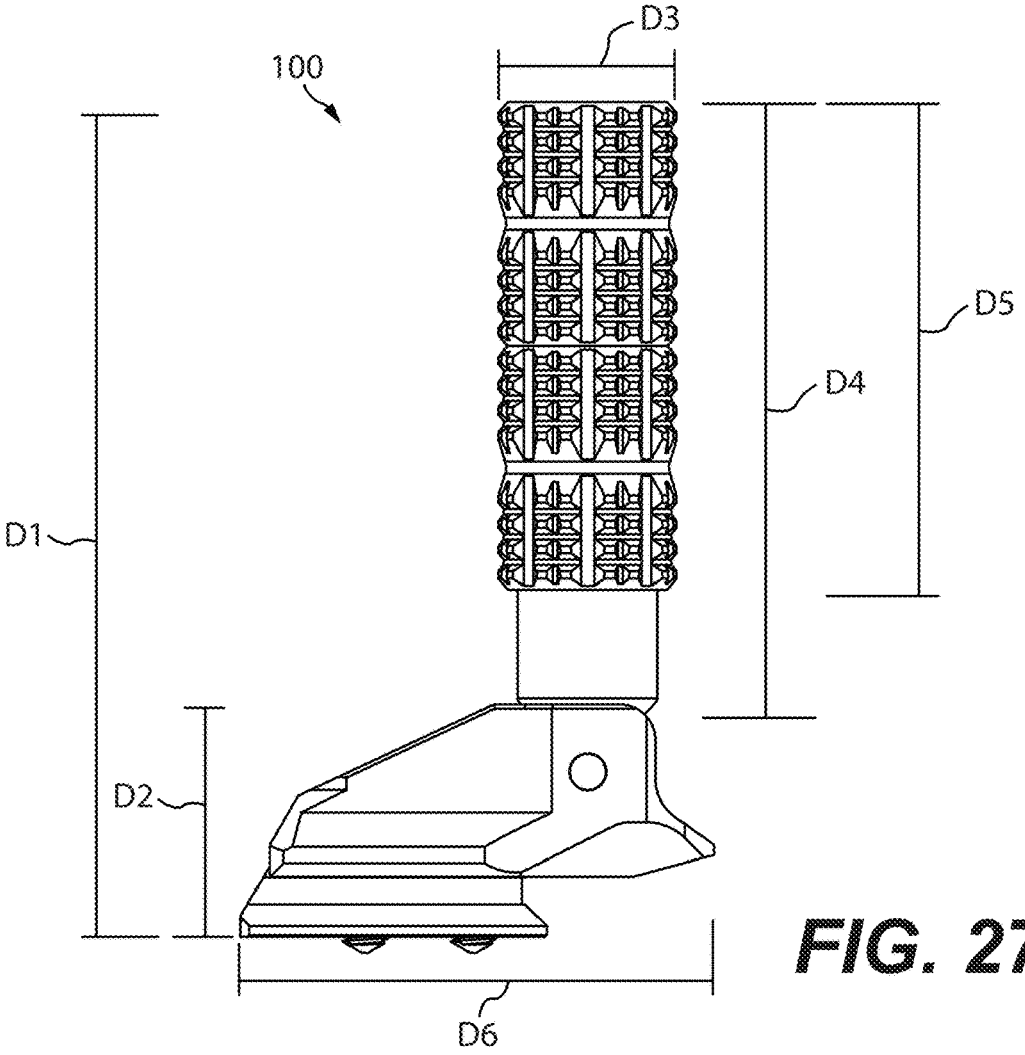
FIG. 27 is a left side view of an embodiment of a mounting interface assembled with a throw lever device depicting the throw lever device set to an operable position.

With reference to FIG. 27, in a first non-limiting example a throw lever device 100 and mounting interface 105 assembled for use with a magnification ring 501 of an optical sight 500 may comprise the dimensions as listed in Table 1.

TABLE 1

| | |
|---|---|
| D1: | 4.62 cm (1.82 inches); |
| D2: | 1.28 cm (0.50 inches); |
| D3: | 1.00 cm (0.39 inches); |
| D4: | 3.34 cm (1.31 inches); |
| D5: | 2.70 cm (1.06 inches); and |
| D6: | 2.62 cm (1.03 inches). |

Figure 28:
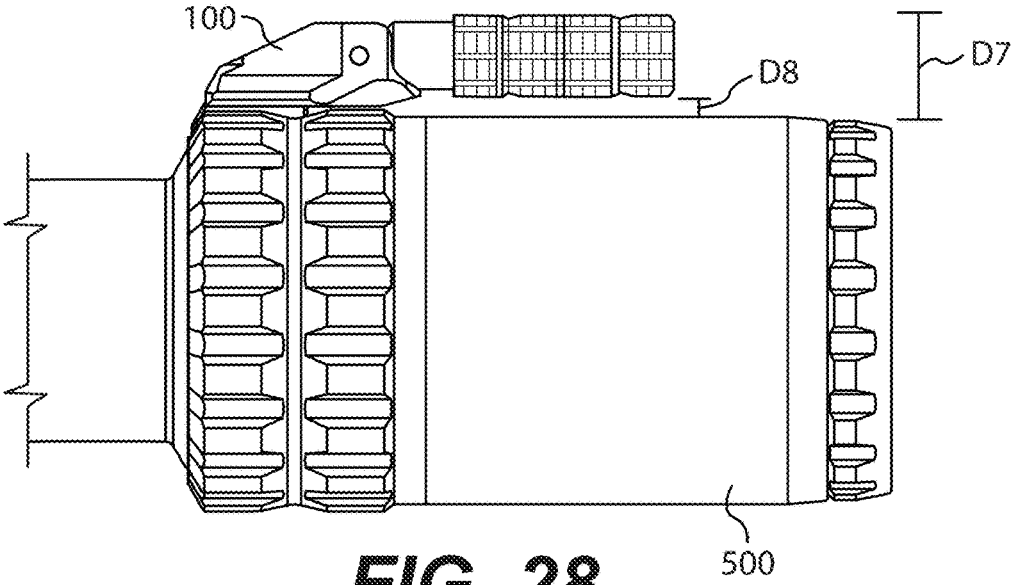
FIG. 28 is a left side view depicting the mounting interface and throw lever device of FIG. 27 attached to a female dovetail mount surface of a magnification ring of a firearm optical sight with the throw lever device set to a non-operable position.
Figure 29:
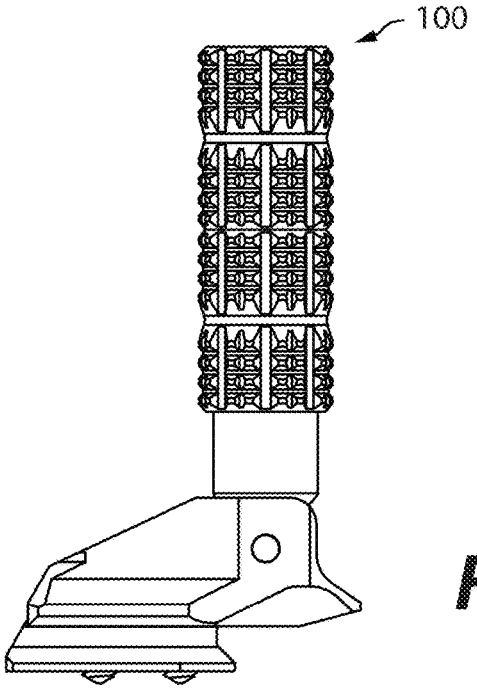
FIG. 29 is a left side view of an embodiment of a mounting interface assembled with a throw lever device depicting the throw lever device set to an operable position.
Figure 31:
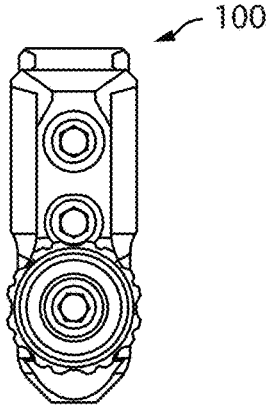
FIG. 31 is a top view of the mounting interface and throw lever device of FIG. 29.
Figure 32:
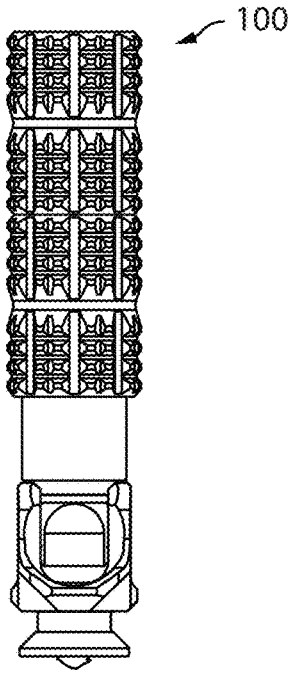
FIG. 32 is a rear view of the mounting interface and throw lever device of FIG. 29.
Figure 30:
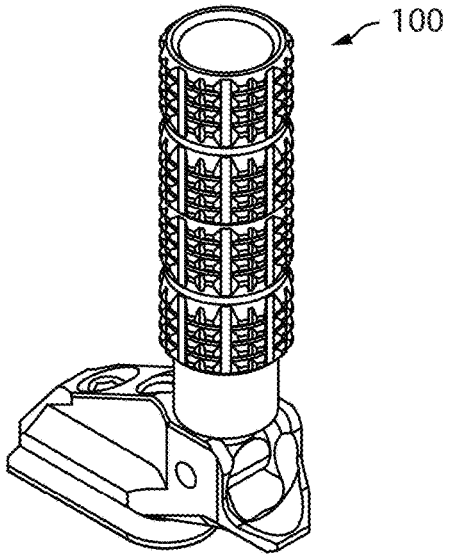
FIG. 30 is a perspective rear view of the mounting interface and throw lever device of FIG. 29.
Figure 33:
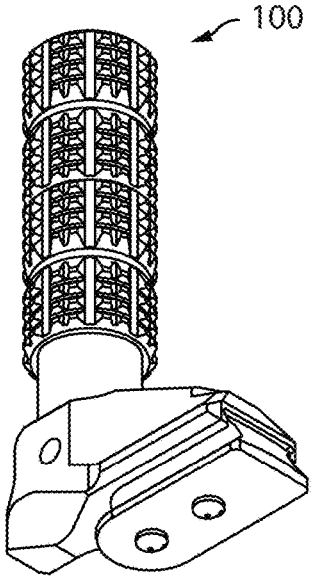
FIG. 33 is a bottom perspective view of the mounting interface and throw lever device of FIG. 29.
Figure 34:
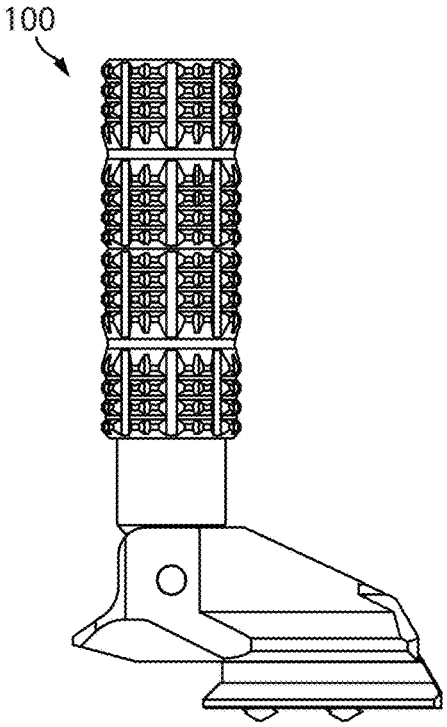
FIG. 34 is a right side view of the mounting interface and throw lever device of FIG. 29.
Figure 35:
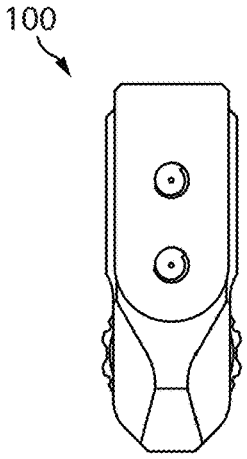
FIG. 35 is a bottom view of the mounting interface and throw lever device of FIG. 29.
Figure 36:
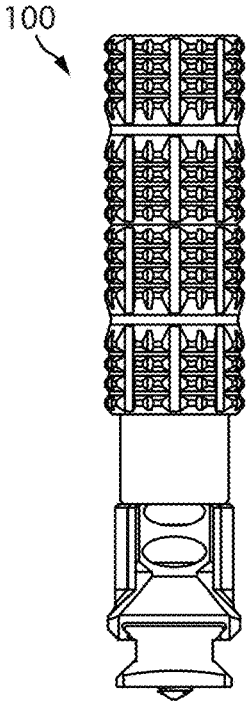
FIG. 36 is a front view of the mounting interface and throw lever device of FIG. 29.
Figure 37:
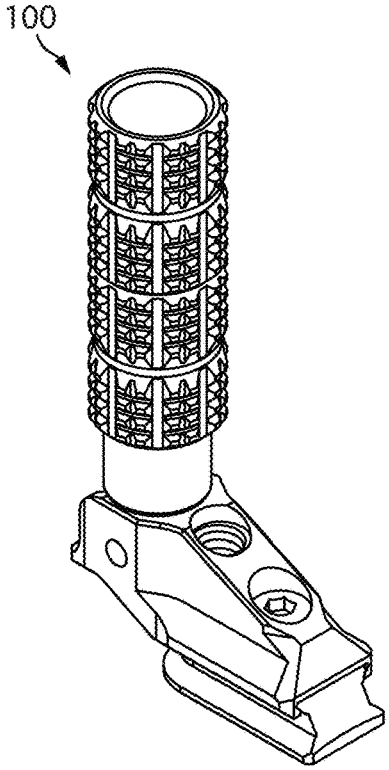
FIG. 37 is a front perspective view of the mounting interface and throw lever device of FIG. 29.

With reference to FIG. 28, when the throw lever device 100 and mounting interface 105 of FIG. 27 are mounted to a magnification ring 501 of an optical sight 500, the throw lever device 100 is spatially disposed adjacent the optical device 500, at least in part, according to the dimensions as listed in Table 2.

TABLE 2

| | |
|---|---|
| D7: | 1.19 cm (0.47 inches); and |
| D8: | 0.206 cm (0.08 inches). |

Example 2

In a second non-limiting example, an assembly of a throw lever device 100 and a mounting interface 105 is provided as shown in FIGS. 29-37.

A system, method, assembly and throw lever device 100 of the present disclosure may be described according to one or more of the following Embodiments.

Embodiment 1. A system, comprising:

at least a first optical sight comprising a magnification ring;

a device including:

a base member attachable to the magnification ring; and a lever member pivotally attached to the base member;

wherein the lever member has a central longitudinal axis;

wherein the lever member comprises a detent assembly axially disposed about the lever member; and wherein the base member and the detent assembly are operationally configured to retain the lever member in a plurality of fixed positions about the base member.

Embodiment 2. The system of Embodiment 1, wherein the first optical sight includes an optical axis and the lever member is operationally configured to rotate about a rotational axis in a first direction and an opposite second direction along a plane perpendicular to the optical axis.

Embodiment 3. The system of Embodiment 2, wherein the plurality of fixed positions include a first fixed position wherein the central longitudinal axis is parallel to the optical axis and a second fixed position offset 90.0 degrees from the first fixed position.

Embodiment 4. The system of Embodiment 1, wherein the base member includes a socket with a first mating surface for holding the lever member in the first fixed position and a second mating surface for holding the lever member in the second fixed position.

Embodiment 5. The system of Embodiment 4, wherein the detent assembly of the lever member includes a post member with an eye end pivotally attached to the base member, an annular plunger, a boss member, and at least one biasing member disposed between the annular plunger and the boss member.

Embodiment 6. The system of Embodiment 5, wherein the detent assembly is operationally configured to bias the annular plunger against the first mating surface and against the second mating surface of the socket.

Embodiment 7. The system of Embodiment 2, wherein the base member includes a socket operationally configured to limit rotation of the lever member in the first direction and the second direction to 90.0 degrees of rotation.

Embodiment 8. A system, comprising:

at least a first optical sight and a second optical sight;

at least a first mounting interface and a second mounting interface;

a device including:

a base member; and a lever member pivotally attached to the base member;

wherein the first optical sight has a first magnification ring with a first mount surface and wherein the second optical sight has a second magnification ring with a second mount surface;

wherein the first mounting interface and the second mounting interface are of a like configuration;

wherein the first mounting interface is releasably attachable to the first mount surface and wherein the second mounting interface is releasably attachable to the second mount surface;

wherein the base member of the device is releasably attachable to the first mounting interface and releasably attachable to the second mounting interface;

wherein the lever member has a central longitudinal axis; and wherein the lever member comprises a detent assembly axially disposed about the lever member.

Embodiment 9. The system of Embodiment 8, wherein the base member and the detent assembly are operationally configured to retain the lever member in a plurality of detented positions about the base member.

Embodiment 10. The system of Embodiment 8, wherein the first magnification ring includes a first outer diameter and the second magnification ring includes a second outer diameter different than the first outer diameter.

Embodiment 11. The system of Embodiment 8, wherein the detent assembly includes a post member pivotally attached to the base member, an annular plunger, a boss member in threaded communication with the post member, and one or more biasing members, wherein the one or more biasing members are operationally configured to bias the annular plunger against the base member.

Embodiment 12. The system of Embodiment 11, wherein the base member includes a first mating surface and a second mating surface and wherein the one or more biasing members are operationally configured to bias the annular plunger against the first mating surface and against the second mating surface.

Embodiment 13. The system of Embodiment 8, wherein each of the first mount surface and the second mount surface includes a female dovetail mount surface.

Embodiment 14. The system of Embodiment 13, wherein the first mounting interface includes a first male dovetail connector for mating with the first mount surface and wherein the second mounting interface includes a second male dovetail connector for mating with the second mount surface.

Embodiment 15. A device for turning a magnification ring of an optical sight, comprising:

a base member attachable to the magnification ring; and a lever member pivotally attached to the base member;

wherein the lever member has a central longitudinal axis; and wherein the lever member comprises a detent assembly axially disposed about the lever member; and wherein the base member and the detent assembly are operationally configured to retain the lever member in a plurality of fixed positions about the base member.

Embodiment 16. An assembly, comprising:

a mounting interface releasably attachable to a magnification ring of an optical sight; and a lever assembly including a base member releasably attachable to the mounting interface and a lever member pivotally attached to the base member, the lever member comprising a detent assembly axially disposed about the lever member;

wherein the base member and the detent assembly are operationally configured to retain the lever member in a plurality of fixed positions about the base member.

Embodiment 17. An assembly, comprising:

a base member attachable to a magnification ring of an optical sight; and a lever member pivotally attached to the base member, the lever member comprising a detent assembly axially disposed about the lever member;

wherein the base member and the detent assembly are operationally configured to retain the lever member in a plurality of fixed positions about the base member.

Embodiment 18. The assembly of Embodiment 17, wherein the base member is attachable to the magnification ring via one or more adhesives.

Embodiment 19. An assembly, comprising:

a mounting interface;

a base member; and a lever member;

wherein the mounting interface is releasably attachable to a magnification ring of an optical sight;

wherein the base member is releasably attachable to the mounting interface; and wherein the lever member is pivotally attached to the base member;

wherein the lever member comprises a detent assembly axially disposed about the lever member; and wherein the base member and the detent assembly are operationally configured to retain the lever member in a plurality of fixed positions about the base member.

Embodiment 20. A method for turning a magnification ring of an optical sight, the method comprising:

manually turning the magnification ring via a device attached to the magnification ring, the device including:

a base member attachable to the magnification ring; and a lever member pivotally attached to the base member;

wherein the lever member has a central longitudinal axis; and wherein the lever member comprises a detent assembly axially disposed about the lever member; and wherein the base member and the detent assembly are operationally configured to retain the lever member in a plurality of fixed positions about the base member including a first fixed position for turning the magnification ring.

Embodiment 21. A method, comprising the following steps:

adjusting magnification of a variable optic sight by manually turning a device attached to a magnification ring of the variable optic sight, the device comprising:

a base member attachable to the magnification ring; and a lever member pivotally attached to the base member;

wherein the lever member has a central longitudinal axis;

wherein the lever member comprises a detent assembly axially disposed about the lever member; and wherein the base member and the detent assembly are operationally configured to retain the lever member in a plurality of fixed positions about the base member including a first fixed position for turning the magnification ring.

Embodiment 22. A method, comprising:

turning a magnification ring via an assembly attached to the magnification ring, the assembly including:

a mounting interface attachable to the magnification ring; and a base member attachable to the mounting interface; and a manually operated lever member pivotally attached to the base member;

wherein the lever member has a central longitudinal axis;

wherein the lever member comprises a detent assembly axially disposed about the lever member; and wherein the base member and the detent assembly are operationally configured to retain the lever member in a plurality of fixed positions about the base member.

Embodiment 23. A system, comprising:

at least a first optical sight comprising a magnification ring;

a throw lever device including:

a base member attachable to the magnification ring; and a lever member pivotally attached to the base member;

wherein the lever member has a central longitudinal axis;

wherein the lever member comprises a detent assembly axially disposed about the lever member; and wherein the base member and the detent assembly are operationally configured to retain the lever member in a plurality of fixed positions about the base member.

Embodiment 24. A system, comprising:

at least a first optical sight and a second optical sight;

at least a first mounting interface and a second mounting interface;

a throw lever device including:

a base member; and a lever member pivotally attached to the base member;

wherein the first optical sight has a first magnification ring with a first mount surface and wherein the second optical sight has a second magnification ring with a second mount surface;

wherein the first mounting interface and the second mounting interface are of a like configuration;

wherein the first mounting interface is releasably attachable to the first mount surface and wherein the second mounting interface is releasably attachable to the second mount surface;

wherein the base member of the throw lever device is releasably attachable to the first mounting interface and releasably attachable to the second mounting interface;

wherein the lever member has a central longitudinal axis; and wherein the lever member comprises a detent assembly axially disposed about the lever member.

Embodiment 25. A throw lever device for turning a magnification ring of an optical sight, comprising:

a base member attachable to the magnification ring; and a lever member pivotally attached to the base member;

wherein the lever member has a central longitudinal axis; and wherein the lever member comprises a detent assembly axially disposed about the lever member; and wherein the base member and the detent assembly are operationally configured to retain the lever member in a plurality of fixed positions about the base member.

Embodiment 26. A throw lever system, comprising:

one or more optical sights, each of the one or more optical sights having a magnification ring with a mount surface; and a device including a (1) base member releasably attachable to each mount surface of each of the one or more optical sights, and (2) a lever member pivotally attached to the base member;

wherein the lever member is operationally configured to set to at least two fixed positions about the base member.

Embodiment 27. A method, comprising:

turning a throw lever device of this disclosure when the throw lever device is attached to a magnification ring of an optical sight.

Although the present disclosure is described above in terms of various exemplary embodiments and implementations, it should be understood that the various features and functionality described in one or more of the individual embodiments are not limited in their applicability to the particular embodiment with which they are described, but instead might be applied, alone or in various combinations, to one or more other embodiments whether or not such embodiments are described and whether or not such features are presented as being a part of a described embodiment. Thus, the breadth and scope of the claimed invention should not be limited by any of the above-described embodiments.

Terms and phrases used in this disclosure, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," "one or a plurality" or the like.

Persons of ordinary skill in the art will recognize that many modifications may be made to the present disclosure without departing from the spirit and scope of the disclosure. The embodiment(s) described herein are meant to be illustrative only and should not be taken as limiting the invention, which is defined in the claims.

I claim:

1. A system, comprising:

at least a first optical sight comprising a magnification ring; and at least a first device including:

a base member; and a lever member pivotally attached to the base member;

wherein the magnification ring includes a mount surface;

wherein the base member includes a mounting surface releasably attachable to the mount surface of the magnification ring; and wherein the mounting surface of the base member includes a planar mounting surface and the mount surface of the magnification ring includes a planar mount surface.

2. The system of claim 1, wherein the lever member comprises a detent assembly axially disposed about the lever member and wherein the base member and the detent assembly are operationally configured to retain the lever member in a plurality of fixed positions about the base member.

3. The system of claim 2, wherein the detent assembly is operationally configured to be biased against different surfaces of the base member to establish the plurality of fixed positions.

4. The system of claim 2, wherein the detent assembly includes a post member, a plunger, a boss member, and one or more biasing members.

5. The system of claim 1, wherein the mount surface of the magnification ring includes one or more threaded holes and the base member includes one or more through holes corresponding to the one or more threaded holes for receiving one or more threaded fasteners.

6. A system, comprising:

at least a first optical sight comprising a magnification ring;

at least a first device including:

a base member; and a lever member pivotally attached to the base member; and at least a first mounting interface;

wherein the magnification ring includes a mount surface;

wherein the at least a first mounting interface is releasably attachable to the mount surface of the magnification ring and wherein the base member is releasably attachable to the at least a first mounting interface; and wherein the mount surface of the magnification ring includes a first slot type female dovetail mount surface, wherein the at least a first mounting interface includes a first male dovetail surface for forming a first dovetail joint with the first slot type female dovetail mount surface, wherein the at least a first mounting interface includes a second male dovetail surface and wherein the base member includes a second slot type female dovetail mount surface for forming a second dovetail joint with the second male dovetail surface.

7. The system of claim 6, wherein the lever member comprises a detent assembly axially disposed about the lever member and wherein the base member and the detent assembly are operationally configured to retain the lever member in a plurality of fixed positions about the base member.

8. The system of claim 7, wherein the detent assembly is operationally configured to be biased against different surfaces of the base member to establish the plurality of fixed positions.

9. The system of claim 6, wherein the mount surface of the magnification ring includes one or more first threaded holes and the at least a first mounting interface includes one or more second threaded holes corresponding to the one or more first threaded holes for receiving one or more first threaded fasteners there through in a manner effective for the one or more first threaded fasteners to mate with the one or more first threaded holes, and wherein the base member includes one or more third threaded holes corresponding to the one or more second threaded holes for receiving one or more second threaded fasteners there through in a manner effective for the one or more second threaded fasteners to mate with the one or more second threaded holes.

10. An assembly for turning a magnification ring of an optical sight, comprising:

a base member;

a lever member; and a mounting interface;

wherein the lever member is attached to the base member;

wherein the mounting interface is releasably attachable to a mount surface on the magnification ring of the optical sight;

wherein the base member is releasably attachable to the mounting interface; and wherein the mounting interface includes one or more first threaded holes and the base member includes one or more second threaded holes corresponding to the one or more first threaded holes for receiving one or more threaded fasteners there through in a manner effective for the one or more threaded fasteners to mate with the one or more first threaded holes of the mounting interface.

11. The assembly of claim 10, wherein the lever member comprises a detent assembly axially disposed about the lever member and wherein the base member and the detent assembly are operationally configured to retain the lever member in a plurality of fixed positions about the base member.

12. The assembly of claim 11, wherein the detent assembly includes a post member, a plunger, a boss member, and one or more biasing members.

13. The assembly of claim 10, wherein the lever member is pivotally attached to the base member.

* * * * *